US007178895B2

(12) United States Patent
Akase

(10) Patent No.: US 7,178,895 B2
(45) Date of Patent: Feb. 20, 2007

(54) CORRECTING METHOD, LIQUID EJECTING APPARATUS, COMPUTER PROGRAM, COMPUTER SYSTEM, AND CORRECTION PATTERN

(75) Inventor: Takashi Akase, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 280 days.

(21) Appl. No.: 10/778,313

(22) Filed: Feb. 17, 2004

(65) Prior Publication Data

US 2004/0223032 A1 Nov. 11, 2004

(30) Foreign Application Priority Data

Feb. 17, 2003 (JP) ..... P.2003-038279

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 4,475,113 A * 10/1984 Lee et al. ..... 347/40
6,196,736 B1 * 3/2001 Otsuki et al. ..... 347/19
6,416,151 B1 * 7/2002 Otsuka et al. ..... 347/19

FOREIGN PATENT DOCUMENTS

JP 7-32654 A 2/1995
JP 7-81190 A 3/1995

* cited by examiner

*Primary Examiner*—Julian D. Huffman
(74) *Attorney, Agent, or Firm*—Sughrue Mion, PLLC

(57) ABSTRACT

A method of operation of a liquid ejecting head, includes: reciprocating the liquid ejecting head in a first direction and a second direction which is an inverse direction of the first direction; ejecting liquid droplets from a plurality of nozzles in the liquid ejecting head while moving the head in the first direction thereby forming first patterns; and ejecting liquid droplets while moving the head in the second direction thereby forming second patterns. Each of the second patterns is adjacent to a first pattern so that the second patterns pair with the first patterns. Widths of the first patterns or the second patterns, or both, in the first direction are different so that each pair has a different correction amounts.

7 Claims, 21 Drawing Sheets

CORRECTING METHOD, LIQUID EJECTING APPARATUS, COMPUTER PROGRAM, COMPUTER SYSTEM, AND CORRECTION PATTERN

BACKGROUND OF THE INVENTION

This invention relates to a correcting method of a difference between dot formation positions in a reciprocally operation of a liquid ejecting head such as a record head used with an image record apparatus such as a printer, a color material ejection head used for manufacturing a color filter of a liquid crystal display, etc., an electrode material ejection head used for electrode formation of an organic EL display, an FED (surface light emission display), etc., or a biological organic substance ejection head used for manufacturing a biochip, a general liquid ejecting apparatus using the liquid ejecting head, a computer program, a computer system, and a correction pattern.

Some ink jet printers wherein a print head ejects ink for printing while the print head scans in a main scanning direction have a function of "two-way print" for ejecting ink in a go way and ejecting ink in a return way for printing.

To perform two-way print in such a printer, correction needs to be made so that dot formation positions of ink droplets ejected in the go way and the return way in the main scanning direction (namely, hit positions of the ink droplets on print paper) match.

As a method of determining the correction amount of a dot formation position, a method disclosed, for example, in JP-A-7-32654 (abstract) is available. Determining the correction amount in a color printer based on such a method will be discussed with reference to FIG. 22. First, in the go way, a plurality of longitudinal lines extending in a sub-scanning direction (500*a* to 500*h*) are printed with a given spacing in the main scanning direction using a nozzle at the tip of a print head. Next, likewise a plurality of longitudinal lines (501*a* to 501*h*) are also printed in the return way. In the return way, a different correction amount is added to the spacing between the longitudinal lines in the go way for printing the longitudinal lines with a little different spacing. In the example in FIG. 22, the difference between the longitudinal lines 500*a* and 501*a* is $\Delta L1$ and the difference between the longitudinal lines 500*b* and 501*b* is $\Delta L2$. $\Delta L1$ and $\Delta L2$ have the relation of $\Delta L1 > \Delta L2$.

The user, etc., selects the point where the longitudinal lines 500*a* to 500*h* printed in the go way and the longitudinal lines 501*a* to 501*h* printed in the return way are printed most linearly, and the correction amount added when the selected longitudinal line was printed is determined to be the correction amount in performing two-way print. In the example in FIG. 22, the longitudinal lines 500*d* and 501*d* are printed most linearly and therefore the correction amount added when the longitudinal lines were drawn is determined to be the correction amount in performing two-way print.

By the way, to print the print correction pattern as shown in FIG. 22, after the longitudinal lines 500*a* to 500*h* are printed in the go way, the print head is moved to the home position (the right end in FIG. 22), a predetermined correction amount is set, and the longitudinal line 501*h* is printed. After the print head is again returned to the home position, a correction amount different from the preceding correction amount is set and the longitudinal line 501*g* is printed. As similar operation is repeated, the longitudinal lines 501*f* to 501*a* are printed and printing the print correction pattern is complete.

Therefore, to draw the longitudinal lines 501*a* to 501*h* in the return way, it becomes necessary to repeat the operation of returning to the home position and setting the correction amount each time one longitudinal line is drawn, and thus there is a problem of taking time in drawing the print correction pattern.

In recent years, to improve the resolution of an image, there has been a trend to decrease the amount of an ink droplet ejected from a print head. For example, in a color printer, etc., it is being common practice that the amount of an ink droplet is about several picoliters.

Therefore, to use an ink droplet of such a minute amount to draw a longitudinal line as shown in FIG. 22, the line width is very narrow and thus the visibility is degraded and an erroneous determination may be made; this is a problem.

To print a natural image (for example, an image picked up by a numeralal camera) in an ink jet printer, seven color inks (for example, pale color inks, namely, light cyan ink and light magenta ink and dark yellow ink in addition to cyan, magenta, yellow, and black inks required at the minimum for color print) may be used. On the other hand, to execute color print of an illustration, etc., requiring only limited colors, four color inks of cyan, magenta, yellow, and black are used and thus light cyan, light magenta, and dark yellow inks are not used. Thus, in recent years, there has been provided an ink jet printer of the type wherein different color inks are provided as separate cartridges and seven print heads to and from which the corresponding ink cartridge can be attached and detached are included. To print a natural image, the seven color ink cartridges are used and to increase the print speed or to print an illustration, cyan, magenta, and yellow ink cartridges can be mounted replacing the light cyan, light magenta, and dark yellow inks for using two print heads for each color to print.

However, to use four color inks to print, the ink cartridges of the same color are mounted on two print heads and thus the dot formation positions of ink droplets ejected in the go way and the return way in the main scanning direction must be corrected for different nozzles for ejecting ink of the same color. On the other hand, to use seven color inks to print, it is desirable that the dot formation positions of ink droplets ejected in the go way and the return way in the main scanning direction should be corrected for the nozzles for ejecting light color inks, particularly the nozzle for ejecting light cyan ink and the nozzle for ejecting light magenta ink.

Thus, as the correction values for correcting the dot formation positions of ink droplets ejected in the go way and the return way in the main scanning direction, those for seven-color print and those for four-color print must be set separately. That is, two print correction patterns for determining the correction values for seven-color print and for four-color print must be printed using different nozzles and thus there is a problem of taking time in printing.

SUMMARY OF THE INVENTION

It is therefore an object of the invention to provide a correcting method, a liquid ejecting apparatus, a computer program, a computer system, and a correction pattern for making it possible to print a print correction pattern rapidly, provide high visibility, and find the correction amount precisely.

In order to achieve the above object, according to the present invention, there is provided a method of correcting a difference between dot formation positions in a reciprocally operation of a liquid ejecting head, comprising the steps of:

reciprocating the liquid ejecting head along a liquid ejecting path in a first direction and a second direction which is an inverse direction of the first direction, the liquid ejecting head having a plurality of nozzles for ejecting a liquid droplet;

ejecting the liquid droplet while moving the liquid ejection head in the first direction so as to form first patterns; and ejecting the liquid droplet while moving the liquid ejection head in the second direction so as to form second patterns, each of the second patterns being adjacent to each of the first patterns so that the second patterns respectively pair with the first patterns, wherein each of the first and the second patterns has a plurality of dots arranged in the first direction and a third direction perpendicular to the first direction to form a block; and wherein the widths of at least one patterns of the first patterns and the second patterns in the first direction are different one another so that pairs of the first patterns and the second patterns have different correction amounts.

In the above method, it is made possible to form the correction pattern rapidly, and even with a liquid electing apparatus for ejecting a small amount of liquid, the visibility of the correction pattern can be improved, so that it is made possible to find the correction amount precisely.

Preferably, the method includes the step of selecting a pair in which opposed sides of blocks of the pair are the nearest among the pairs as an appropriate correction amount. Especially, the opposed sides do not enter the opposed block.

In the above method, the opposed sides of each of pattern pairs of the first and second patterns are used as the reference, whereby it is made possible to easily select the appropriate correction amount.

Preferably, the liquid ejecting head has a plurality of nozzle rows, each extended in the third direction. The first patterns and the second patterns are formed by using different nozzle rows.

In the above method, when two-way ejection using a plurality of nozzle rows (liquid, especially inks) is executed, it is made possible to find the correction amount such that color overlap between the nozzles becomes appropriate.

Preferably, if a plurality of nozzle rows as targets to find the correction amount exist, the method further includes the step of ejecting the liquid droplet while moving the liquid ejection head in the second direction so as to form third patterns, each of the third patterns being adjacent to each of the first patterns so that the third patterns respectively pair with the first patterns. Pairs of the first patterns and the third patterns respectively have different correction amounts. The second patterns and the third patterns are formed by using different nozzle rows of the liquid ejecting head. A correction amount of one nozzle row is determined based on the pairs of the first patterns and the second patterns. A correction amount of another nozzle row is determined based on the pairs of the first patterns and the third patterns.

In the above method, when two-way ejection using a plurality of nozzle rows (inks) is executed, it is made possible to find the correction amount such that color overlap between the nozzles becomes appropriate.

Preferably, the liquid droplet is ejected in a first ejecting mode for ejecting in a first number of liquid colors and in a second ejecting mode for ejecting in a second number of liquid colors. The first patterns are formed by ejecting the liquid droplet from a nozzle row used in common in both the first ejecting mode and the second ejecting mode. The second patterns and the third patterns are formed by ejecting the liquid droplet from different nozzle rows used separately in the first and second ejecting modes.

In the above method, it is made possible to find the correction amounts of both of the first and second ejecting modes at the same time.

Preferably, the first patterns and the second patterns are formed by ejecting the droplet from a part of nozzles of each nozzle row. The part of nozzles is arranged in a vicinity of a center part in each nozzle row.

In the above method, even if the nozzles are mounted having an inclination relative to the second direction, it is made possible to find the correction amount precisely.

According to the present invention, there is also provided a liquid ejecting apparatus, comprising:

a liquid ejecting head, reciprocately moving along a liquid ejecting path in a first direction and a second direction which is an inverse direction of the first direction, the liquid ejecting head having a plurality of nozzles for ejecting a liquid droplet, wherein the liquid ejecting head ejects the liquid droplet while moving in the first direction so as to form first patterns;

wherein the liquid ejecting head ejects the liquid droplet while moving in the second direction so as to form second patterns, each of the second patterns being adjacent to each of the first patterns so that the second patterns respectively pair with the first patterns;

wherein each of the first and the second patterns has a plurality of dots arranged in the first direction and a third direction perpendicular to the first direction to form a block; and wherein the widths of at least one patterns of the first patterns and the second patterns in the first direction are different one another so that pairs of the first patterns and the second patterns have different correction amounts to correct a difference between dot formation positions in a reciprocally operation of the liquid ejecting head.

In the above configuration, it is made possible to form the correction pattern rapidly, and even with the liquid ejecting apparatus for ejecting a small amount of liquid, the visibility of the correction pattern can be improved, so that it is made possible to find the correction amount precisely.

According to the present invention, there is also provided a program of correcting a difference between dot formation positions in a reciprocally operation of a liquid ejecting head, comprising the steps of:

reciprocating the liquid ejecting head along a liquid ejecting path in a first direction and a second direction which is an inverse direction of the first direction, the liquid ejecting head having a plurality of nozzles for ejecting a liquid droplet;

ejecting the liquid droplet while moving the liquid ejection head in the first direction so as to form first patterns; and ejecting the liquid droplet while moving the liquid ejection head in the second direction so as to form second patterns, each of the second patterns being adjacent to each of the first patterns so that the second patterns respectively pair with the first patterns, wherein each of the first and the second patterns has a plurality of dots arranged in the first direction and a third direction perpendicular to the first direction to form a block; and wherein the widths of at least one patterns of the first patterns and the second patterns in the first direction are different one another so that pairs of the first patterns and the second patterns have different correction amounts.

In the above configuration, it is made possible to form the correction pattern rapidly, and even with the liquid ejecting apparatus for ejecting a small amount of liquid, the visibility of the correction pattern can be improved, so that it is made possible to find the correction amount precisely.

According to the present invention, there is also provided a computer system for correcting a difference between dot formation positions in a reciprocally operation of a liquid ejecting head, comprising:

a liquid ejecting apparatus, including the liquid ejecting head which is reciprocated along a liquid ejecting path in a first direction and a second direction which is an inverse direction of the first direction, the liquid ejecting head having a plurality of nozzles for ejecting a liquid droplet; and a computer, connected to the liquid ejecting apparatus, wherein the liquid ejecting head ejects the liquid droplet while moving in the first direction so as to form first patterns;

wherein the liquid ejecting head ejects the liquid droplet while moving in the second direction so as to form second patterns, each of the second patterns being adjacent to each of the first patterns so that the second patterns respectively pair with the first patterns;

wherein each of the first and the second patterns has a plurality of dots arranged in the first direction and a third direction perpendicular to the first direction to form a block; and wherein the widths of at least one patterns of the first patterns and the second patterns in the first direction are different one another so that pairs of the first patterns and the second patterns have different correction amounts.

In the above configuration, it is made possible to form the correction pattern rapidly, and even with the liquid ejecting apparatus for ejecting a small amount of liquid, the visibility of the correction pattern can be improved, so that it is made possible to find the correction amount precisely.

According to the present invention, there is also provided a correction pattern for use with a liquid ejecting apparatus which includes the liquid ejecting head reciprocated along a liquid ejecting path in a first direction and a second direction which is an inverse direction of the first direction, the liquid ejecting head having a plurality of nozzles for ejecting a liquid droplet, the correction pattern comprising:

first patterns, formed by ejecting the liquid droplet while moving the liquid ejection head in the first direction; and second patterns, formed by ejecting the liquid droplet while moving the liquid ejection head in the second direction, wherein each of the second patterns is adjacent to each of the first patterns so that the second patterns respectively pair with the first patterns;

wherein each of the first and the second patterns has a plurality of dots arranged in the first direction and a third direction perpendicular to the first direction to form a block; and wherein the widths of at least one patterns of the first patterns and the second patterns in the first direction are different one another so that pairs of the first patterns and the second patterns have different correction amounts to correct a difference between dot formation positions in a reciprocally operation of the liquid ejecting head.

In the above configuration, it is made possible to form the correction pattern rapidly, and even with the liquid ejecting apparatus for ejecting a small amount of liquid, the visibility of the correction pattern can be improved, so that it is made possible to find the correction amount precisely.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Referring to the accompanying drawings, there is shown preferred embodiments of the invention.

Figure 1:
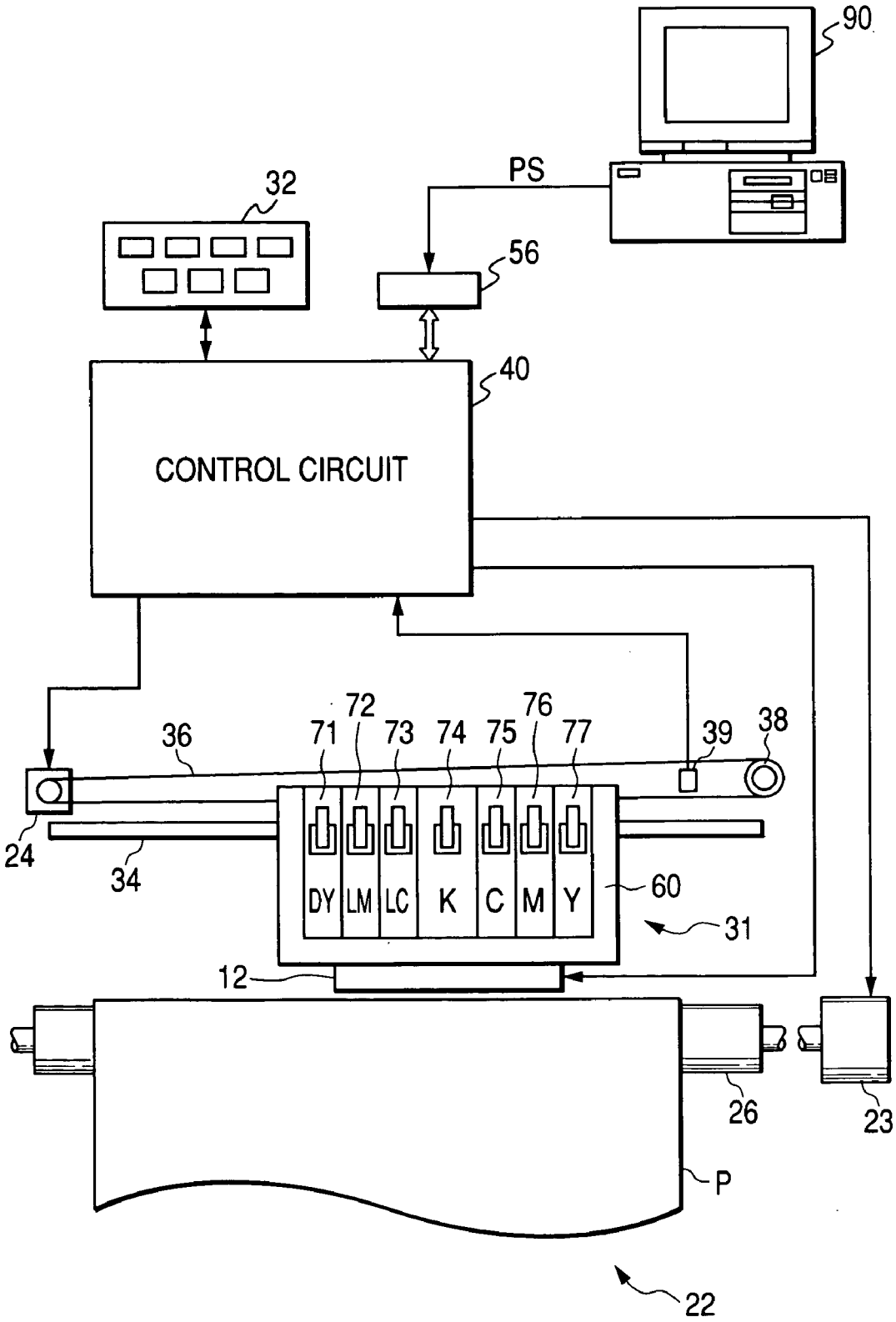
FIG. 1 is a drawing to show the schematic configuration of a printer and a print computer system according to an embodiment of the invention.
Figure 2:
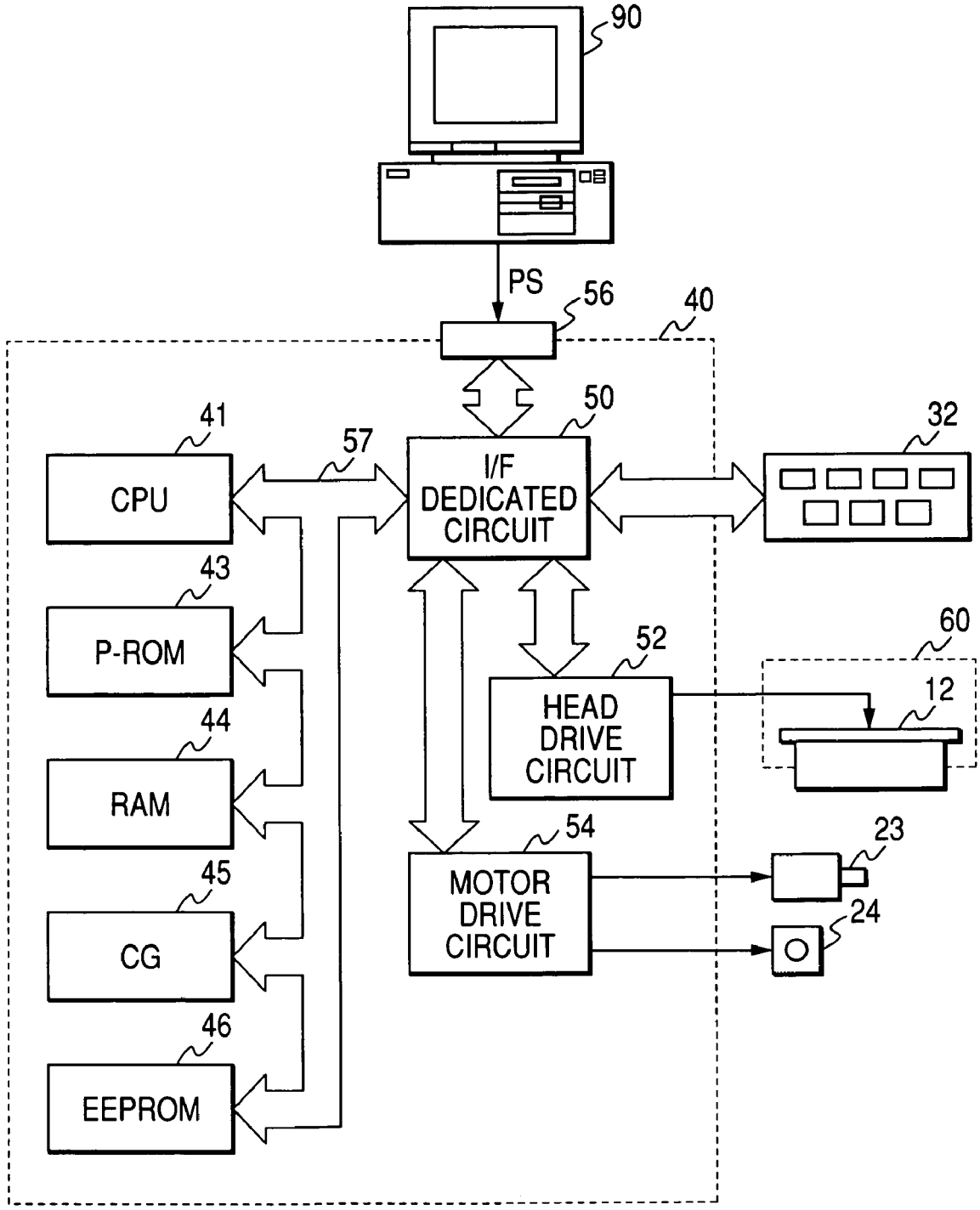
FIG. 2 is a block diagram to show the configuration of the printer centering on a control circuit in the print computer system shown in FIG. 1.

To begin with, an outline of a printer and a print computer system will be discussed with reference to FIGS. 1 and 2. FIG. 1 is a schematic drawing to show the configuration of a print computer system including an ink jet printer (simply, printer) 22. FIG. 2 is a block diagram to show a configuration example of the printer 22 centering on a control circuit 40.

The printer 22 has a subscanning feed mechanism for transporting print paper P by a paper feed motor 23 and a main scanning feed mechanism for reciprocating a carriage 31 in the axial direction of a platen 26 by a carriage motor 24. Here, the feed direction of the print paper P by the subscanning feed mechanism is called the subscanning direction, and the move direction of the carriage 31 by the main scanning feed mechanism is called the main scanning direction.

The printer 22 also includes a print head unit 60 mounted on the carriage 31 and including a print head 12, a head drive mechanism for driving the print head unit 60 and controlling ejection of ink and dot formation, and the control circuit 40 for controlling transfer of signals to and from the paper feed motor 23, the carriage motor 24, the print head unit 60, and an operation panel 32.

The control circuit 40 is connected to a computer 90 through a connector 56. A driver for the printer 22 is installed in the computer 90, and the computer 90 provides a user interface for accepting a command of the user who operates a keyboard, a mouse, etc., as an input unit and presenting various pieces of information on the printer 22 on a screen of a display.

The subscanning feed mechanism for transporting print paper P includes a gear train (not shown) for transmitting rotation of the paper feed motor 23 to the platen 26 and a paper transport roller (not shown).

The main scanning feed mechanism for reciprocating the carriage 31 includes a slide shaft 34 being placed in parallel with the shaft of the platen 26 for slidably holding the carriage 31, a pulley 38 for stretching an endless drive belt 36 between the pulley 38 and the carriage motor 24, and a position detection sensor 39 for detecting the origin point position of the carriage 31.

As shown in FIG. 2, the control circuit 40 is implemented as an arithmetic and logic circuit including a CPU (central processing unit) 41, PROM (programmable read-only memory) 43, RAM (random access memory) 44, a character generator (CG) 45 storing dot matrixes of characters, and EEPROM (electrically erasable programmable ROM) 46.

The control circuit 40 further includes an I/F dedicated circuit 50 of an interface with an external motor, etc., a head drive circuit 52 being connected to the I/F dedicated circuit 50 for driving the print head unit 60 for ejecting ink, and a motor drive circuit 54 for driving the paper feed motor 23 and the carriage motor 24.

The I/F dedicated circuit 50, which contains a parallel interface circuit, can receive a print signal PS supplied from the computer 90 through the connector 56.

Next, the configuration of the computer 90 will be discussed with reference to FIG. 3.

Figure 3:
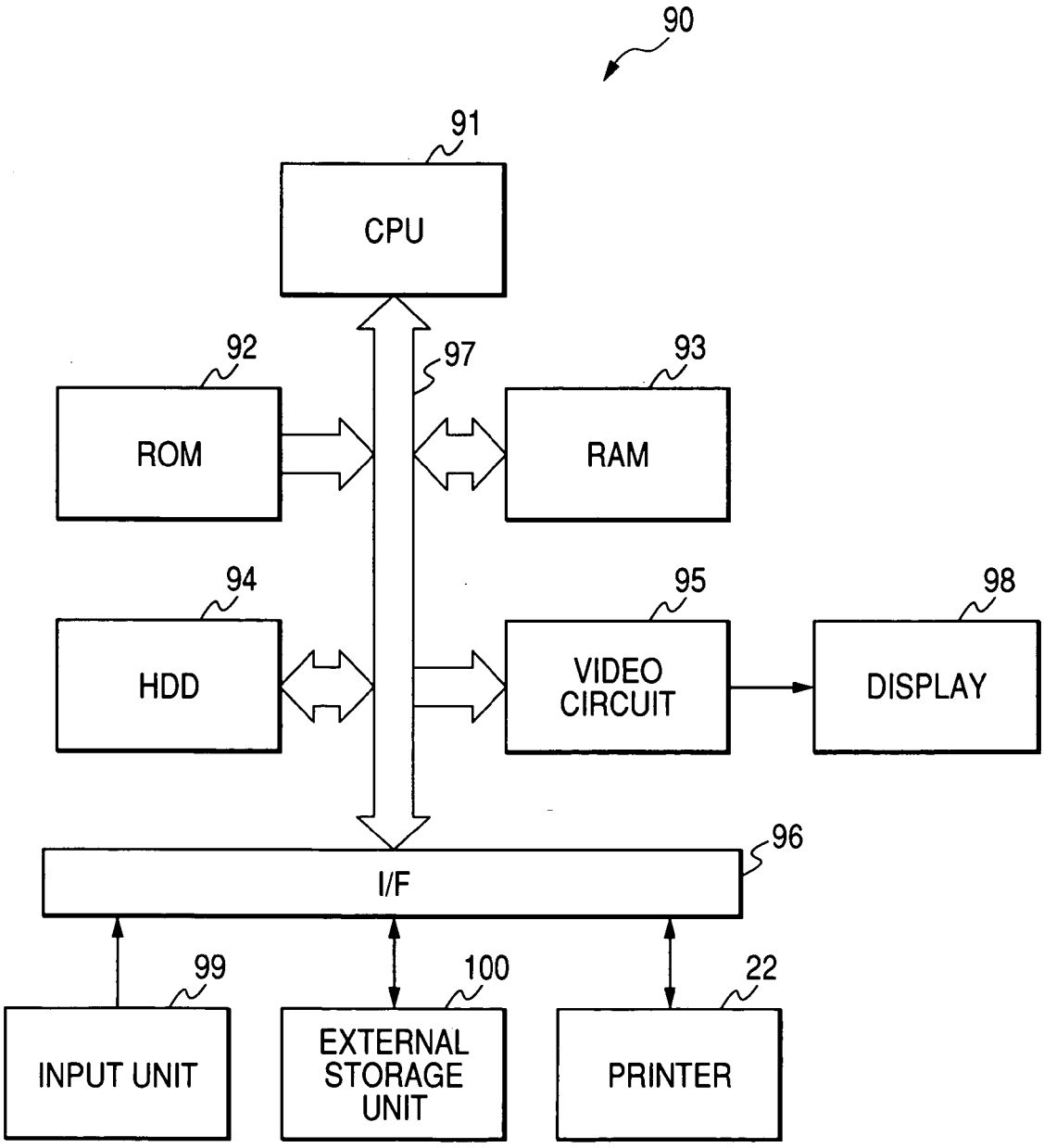
FIG. 3 is a block diagram to show the detailed configuration of a computer in the print computer system shown in FIG. 1.

As shown in FIG. 3, the computer 90 includes a CPU 91, ROM 92, RAM 93, an HDD (hard disk drive) 94, a video circuit 95, an I/F 96, a bus 97, a display 98, an input unit 99, and an external storage unit 100.

The CPU 91 is a control section for executing various types of operation processing and controlling the sections of the computer in accordance with programs stored in the ROM 92 and the HDD 94.

The ROM 92 is memory storing the basic programs executed by the CPU 91 and data.

The RAM 93 is memory for temporarily storing the program being executed by the CPU 91, the data on which operations are being performed, and the like.

The HDD 94 is a record apparatus for reading data and a program recorded on a hard disk of a record medium in response to a request received from the CPU 91 and recording the data occurring as the result of the operation processing performed by the CPU 91 on the hard disk.

The video circuit 95 is a circuit for executing drawing processing in response to a drawing instruction supplied from the CPU 91, converting the provided image data into a video signal, and outputting the video signal to the display 98.

The I/F 96 is a circuit for appropriately converting the representation format of each of the signals output from the input unit 99 and the external storage unit 100 and also outputting the print signal PS to the printer 22.

The bus 97 is a signal line for connecting the CPU 91, the ROM 92, the RAM 93, the HDD 94, the video circuit 95, and the I/F 96 to each other and enabling transfer of data between them.

The display 98 is implemented as an LCD (liquid crystal display) or a CRT (cathode-ray tube), for example, for displaying an image responsive to the video signal output from the video circuit 95.

The input unit 99 is a unit implemented as a keyboard and a mouse, for example, for generating a signal responsive to user's operation and supplying the signal to the I/F 96.

The external storage unit 100 is a unit implemented as a CD-ROM (compact disk-ROM) drive, an MO (magneto-optical) drive, or an FDD (floppy disk drive), for example, for reading data and a program recorded on a CD-ROM disk, an MO disk, or an FD and supplying the read data and program to the CPU 91. If the external storage unit 100 is an MO drive or an FDD, it is a unit for recording the data supplied from the CPU 91 on an MO disk or an FD.

Figure 4A:
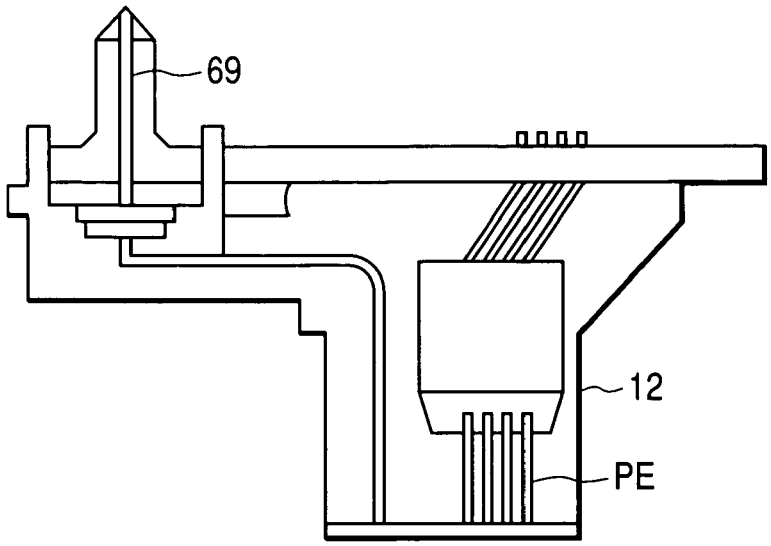
FIGS. 4A and 4B are drawings to show the internal schematic configuration of a print head used with the printer shown in FIG. 1.
Figure 4B:
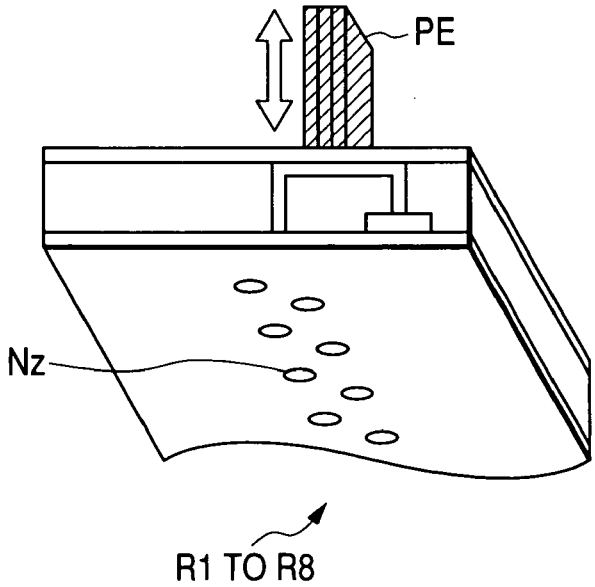
Figure 5A:
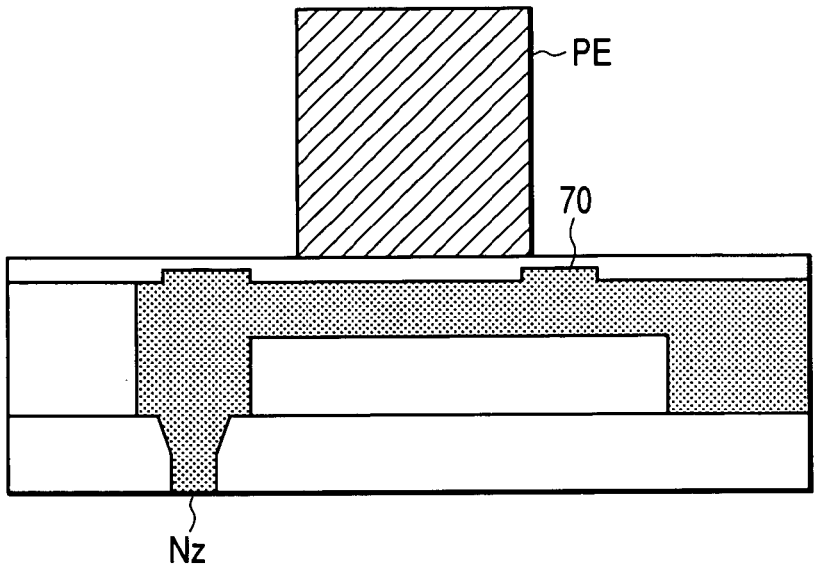
FIGS. 5A and 5B are drawings to show the structure of a piezoelectric element and a nozzle of the print head in the printer shown in FIG. 1 in detail.
Figure 5B:
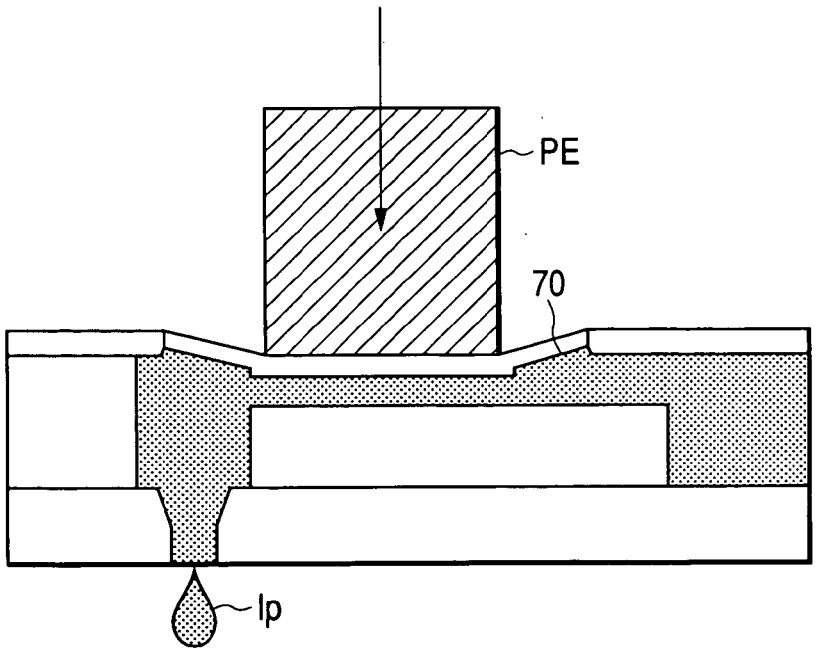

Next, the configuration of the print head 12 will be discussed with reference to FIGS. 4A, 4B, 5A and 5B. FIGS. 4A and 4B are drawings to show the internal schematic configuration of the print head 12. FIGS. 5A and 5B are drawings to show the structure of a piezoelectric element PE and a nozzle Nz in detail.

As shown in FIG. 1, ink cartridges 71 to 77 respectively storing seven color inks of dark yellow (DY), light magenta (LM), light cyan (LC), black (K), cyan (C), magenta (M), and yellow (Y) are detachably mounted on the carriage 31.

As shown in FIG. 1, the print head 12 is placed in the lower part of the carriage 31. The print head 12 is provided with nozzle rows R1 to R8 each as an ink ejection section having nozzles Nz as ink ejection parts arranged like a row along the transport direction of the print paper P, as shown in FIG. 4. The arrangement of the nozzles Nz in the print head 12 will be discussed later.

As shown in FIG. 4A, the carriage 31 is formed at the bottom with each introduction pipe 69 for introducing ink from an ink tank into each color print head. If the ink cartridges 71 to 77 are mounted on the carriage 31 from above, the introduction pipes 69 are inserted into connection holes of the ink cartridges 71 to 77, making it possible to supply ink from the ink cartridges 71 to 77 to the nozzles Nz (see FIG. 4B).

When the ink cartridges 71 to 77 are mounted on the cartridge 31, the ink in the ink cartridges 71 to 77 is sucked through the introduction pipes 69 (see FIG. 4A) and is introduced into the nozzles Nz (see FIG. 4B) provided in the lower part of the carriage 31.

In the nozzle rows R1 to R8 provided for each color in the lower part of the carriage 31, a piezoelectric element PE excellent in responsivity, one of electrostrictive elements, is placed for each nozzle (see FIGS. 4A and 4B). As shown in FIG. 5A, the piezoelectric element PE is placed at a position touching a member for forming an ink passage 70 for guiding ink to the nozzle Nz. As a voltage is applied, the piezoelectric element PE has a crystalline structure deformed for converting electric energy into mechanical energy at extremely high speed.

In the embodiment, a voltage of a predetermined duration is applied across electrodes provided at both ends of the piezoelectric element PE, whereby the piezoelectric element PE is expanded as long as the voltage application time, deforming one side wall of the ink passage 70, as shown in FIG. 5B. Consequently, the volume of the ink passage 70 is contracted in response to the expansion of the piezoelectric element PE and ink as much as the contraction is ejected as an ink droplet Ip from the tip of the nozzle Nz at high speed. As the ink droplet Ip is dropped on a print paper P on the platen 26, a dot is formed for printing.

Figure 6:
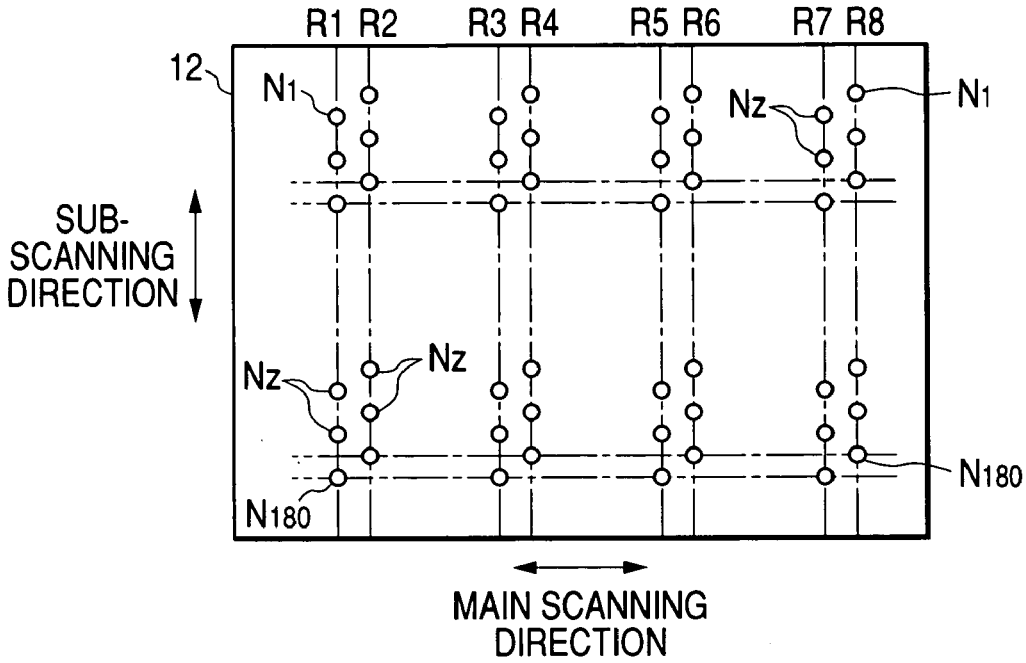
FIG. 6 is a drawing to show the arrangement of the nozzles and nozzle rows in the print head used with the printer shown in FIG. 1.

FIG. 6 is a drawing to show the arrangement of the ink jet nozzles Nz in the print head 12. The nozzle rows R1 to R8 each having 180 nozzles Nz placed like a row along the subscanning direction are formed side by side in the main scanning direction. The nozzles Nz belonging to a pair of adjacent nozzle rows of the eight nozzle rows R1 to R8 (for example, R1 and R2) are staggered at a predetermined pitch in the subscanning direction, and the nozzles Nz belonging to a pair of alternate nozzle rows (for example, R1 and R3) are placed at the same position in the subscanning direction.

In the print head 12 according to the embodiment, ink supplied to the eight nozzle rows R1 to R8 changes from dark color to light color from the nozzle row R4, R5 positioned at the center of the print head 12 in the main scanning direction orthogonal to the subscanning direction toward the nozzle row R1, R8 at the end.

Specifically, black-based ink is ejected from a pair of adjacent nozzle rows R4 and R5 positioned at the center of the print head 12 in the main scanning direction, cyan-based ink is ejected from a pair of nozzle rows R3 and R6 positioned on the outsides of the nozzle rows R4 and R5, magenta-based ink is ejected from a pair of nozzle rows R2 and R7 positioned on the outsides of the nozzle rows R3 and R6, and yellow-based ink is ejected from a pair of nozzle rows R1 and R8 positioned on the outsides of the nozzle rows R2 and R7.

The black-based ink is black ink (K), the cyan-based ink is cyan ink (C) or light cyan ink (LC), the magenta-based ink is magenta ink (M) or light magenta ink (LM), and the yellow-based ink is yellow ink (Y) or dark yellow ink (DY).

The printer 22 of the embodiment enables the user to select a seven-color print mode (high-quality print mode) as first color number print or a four-color print mode (high-speed print mode) as second color number print. In the seven-color print mode, cyan ink (C) is ejected from one nozzle row R6 of the pair of nozzle rows R3 and R6 for ejecting cyan-based ink and light cyan ink (LC) is ejected from the other nozzle row R3; magenta ink (M) is ejected from one nozzle row R7 of the pair of nozzle rows R2 and R7 for ejecting magenta-based ink and light magenta ink (LM) is ejected from the other nozzle row R2; and yellow ink (Y) is ejected from one nozzle row R8 of the pair of nozzle rows R1 and R8 for ejecting yellow-based ink and dark yellow ink (DY) is ejected from the other nozzle row R1.

On the other hand, in the four-color print mode, cyan ink (C) is ejected from both of the pair of nozzle rows R3 and R6 for ejecting cyan-based ink; magenta ink (M) is ejected from both of the pair of nozzle rows R2 and R7 for ejecting magenta-based ink; and yellow ink (Y) is ejected from both of the pair of nozzle rows R1 and R8 for ejecting yellow-based ink.

Figure 7:
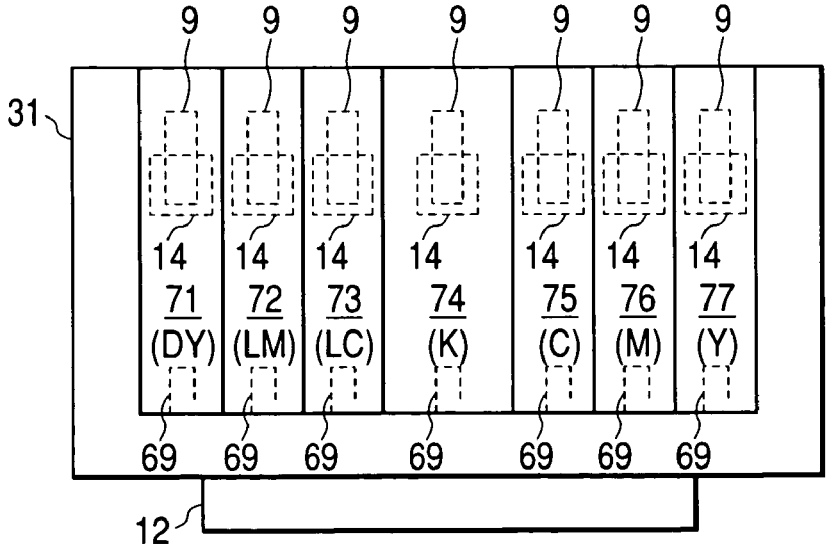
FIG. 7 is a drawing to show the schematic configuration of a carriage in the printer shown in FIG. 1.

In the printer 22 of the embodiment, the ink cartridges 71 to 77 can be detachably mounted on the carriage 31, as shown in FIG. 1. More particularly, the ink cartridges 71 to 77 filled with color inks ejected from the nozzles Nz of the print head 12 can be detachably mounted separately as shown in FIG. 7. In the embodiment, the ink cartridge 71 is filled with dark yellow (DY); the ink cartridge 72 is filled with light magenta (LM); the ink cartridge 73 is filled with light cyan (LC); the ink cartridge 74 is filled with black (K); the ink cartridge 75 is filled with cyan (C); the ink cartridge 76 is filled with magenta (M); and the ink cartridge 77 is filled with yellow (Y).

Further, the carriage 31 is provided with contact terminals 9 in a one-to-one correspondence with the ink cartridges 71 to 77. The contact terminals 9 are provided for electrically reading various pieces of information stored in ROM 14 contained in the ink cartridges 71 to 77, for example, information concerning the type of filled ink. That is, when any of the ink cartridges 71 to 77 is mounted on the carriage 31, the ROM 14 and the contact terminal 9 come in contact with each other for conducting, enabling the control circuit 40 to read the information stored in the ROM 14 through the contact terminal 9. The ROM 14 can be implemented as a rewritable storage device such as EEPROM.

The control circuit 40 identifies the type of ink filled in each of the ink cartridges 71 to 77 based on the information read from the ROM 14 contained in each of the ink cartridges 71 to 77 and determines whether or not the ink filled in each of the ink cartridges 71 to 77 matches the specified seven-color or four-color print mode.

If it is determined that any of the ink cartridges 71 to 77 mounted on the carriage 31 does not store the predetermined type of ink, a warning sound or a warning indication is produced for prompting the user to check the ink cartridges 71 to 77.

The control circuit 40 may identify the types of inks filled in the ink cartridges 71 to 77 based on the information read from the ROM 14 and automatically switch the seven-color or four-color print mode in response to the types of inks filled in the ink cartridges 71 to 77.

Next, driving of the print head 12 will be described with reference to FIG. 8.

Figure 8:
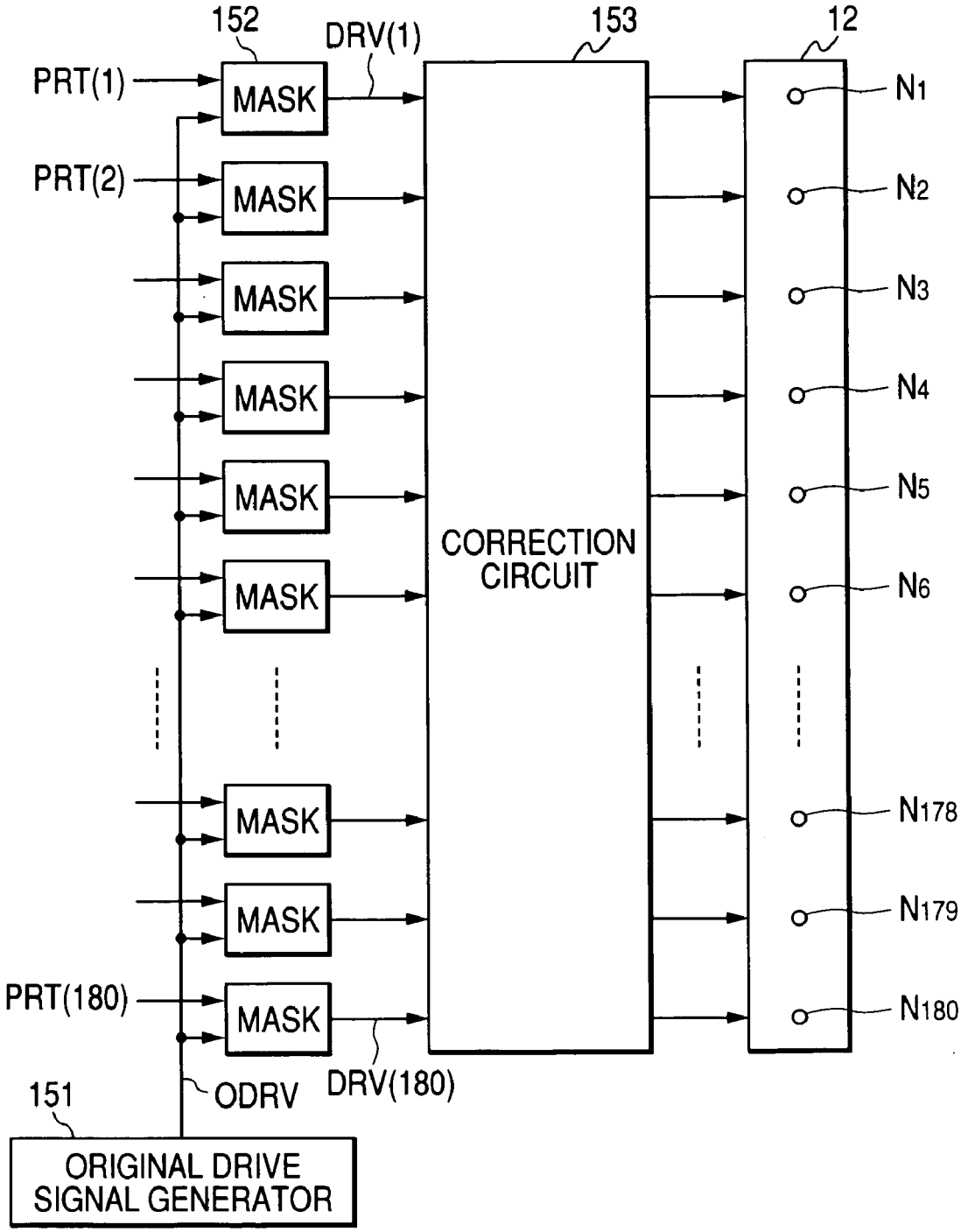
FIG. 8 is a block diagram to show the configuration of a drive signal generator provided in a head drive circuit used in the printer shown in FIG. 1.

FIG. 8 is a block diagram to show the configuration of a drive signal generator provided in the head drive circuit 52 (see FIG. 2). As shown in the figure, the drive signal generation section includes an original drive signal generator 151, a plurality of mask circuits 152, and a correction circuit 153.

Figure 9:
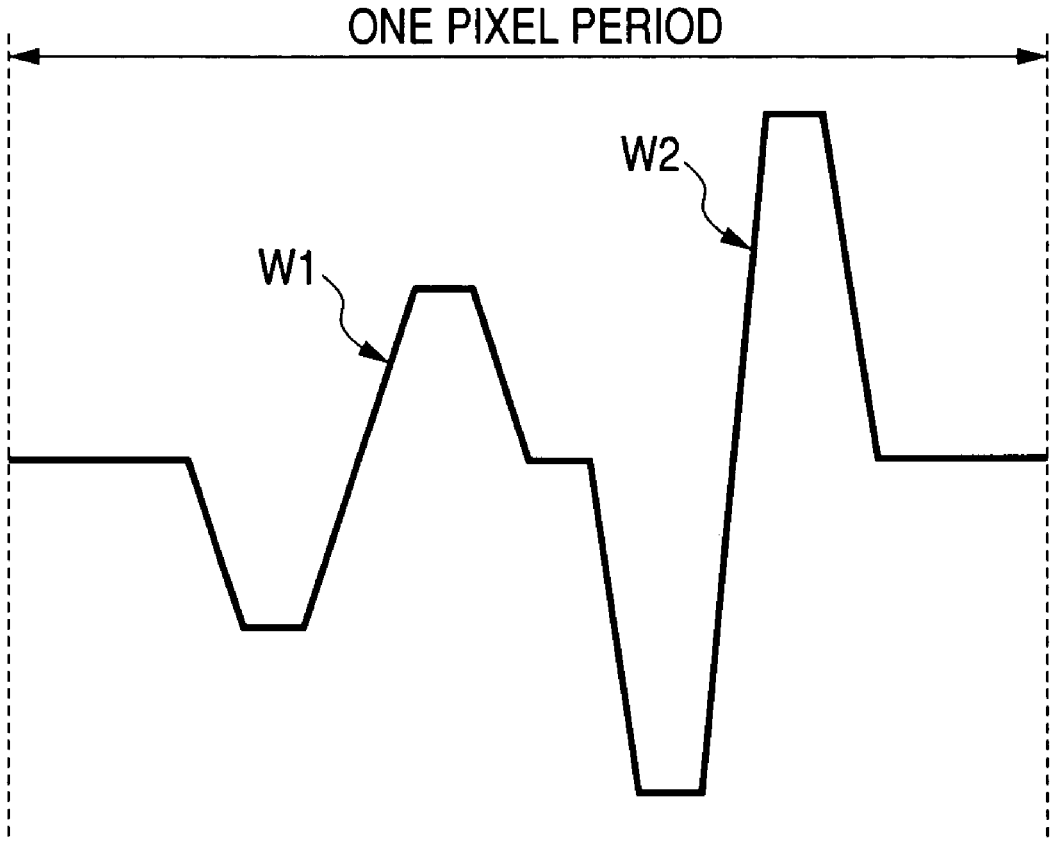
FIG. 9 is a drawing to show time change of a serial print signal in one pixel period in the printer shown in FIG. 1.

The original drive signal generator 151 generates an original drive signal ODRV used in common to the nozzles $N_1$ to $N_{180}$ making up one nozzle row. The original drive signal ODRV is a signal containing two pulses of a first pulse W1 and a second pulse W2 generated in the main scanning time period for one pixel, as shown in FIG. 9. The correction circuit 153 differences back and forth the timing of the drive signal waveform shaped by the mask circuit 152 in the whole return way for correcting the timing of the drive signal waveform. As the timing of the drive signal waveform is corrected, the difference between the ink droplet hit positions in the go way and the return way is corrected, namely, the difference between the dot formation positions in the go way and the return way is corrected.

The mask circuits 152 are provided in a one-to-one correspondence with the piezoelectric elements for driving the nozzles $N_1$ to $N_{180}$ of the print head 12 and mask pixels which need not be printed in response to the state of a serial print signal PRT (i) (i is 1 to 180). In FIG. 8, the numeral in parentheses suffixed on each signal name denotes the number of the nozzle to which the signal is supplied.

As shown in FIG. 8, the input serial print signal PRT (i) is input to each mask circuit 152 together with the original drive signal ODRV output from the original drive signal generator 151. The serial print signal PRT (i) is a serial signal of two bits per pixel, and the two bits correspond to the first pulse W1 and the second pulse W2, as shown in FIG. 9.

The mask circuit 152 masks the original drive signal ODRV in response to the level of the serial print signal PRT (i). That is, when the serial print signal PRT (i) is logical "1," the mask circuit 152 allows the corresponding pulse of the original drive signal ODRV to pass through for supplying drive signal DRV to the piezoelectric element PE; on the other hand, when the serial print signal PRT (i) is logical "0," the mask circuit 152 shuts off the corresponding pulse of the original drive signal ODRV.

The correction method of the dot formation position difference is to intentionally shift the ink ejection timing in the return way in the whole return way so as to make inconspicuous the difference between dot formation positions in the go way and the return way. The ink ejection timing in the go way may be intentionally shifted in the whole go way or the ink ejection timings in the go way and the return way may be intentionally shifted in the whole go way and the whole return way. The difference between the dot formation positions in the main scanning direction in the go way and the return way is caused by variations in the ink ejection speed, backlash of the drive mechanism in the main scanning direction, warp of the platen 26 for supporting the print paper P, etc.

The operation of the embodiment is as follows: First, an outline of the operation of the embodiment will be discussed and then the detailed operation will be discussed.

The printer 22 of the embodiment is set so as to eject dark yellow (DY) ink from the nozzle row R1, light magenta (LM) ink from the nozzle row R2, light cyan (LC) ink from the nozzle row R3, black (K) ink from the nozzle rows R4 and R5, cyan (C) ink from the nozzle row R6, magenta (M) ink from the nozzle row R7, and yellow (Y) ink from the nozzle row R8 in the seven-color print mode. As the ink cartridges 71 to 73 for supplying ink to the nozzle rows R1 to R3 are replaced, four-color print is made possible, as described above. That is, to print in the four-color print mode, the ink cartridges 71 to 73 are replaced so as to eject yellow (Y) ink from the nozzle row R1 for ejecting dark yellow (DY) ink in the seven-color print mode, magenta (M) ink from the nozzle row R2 for ejecting light magenta (LM) ink in the seven-color print mode, and cyan (C) ink from the nozzle row R3 for ejecting light cyan (LC) ink in the seven-color print mode.

By the way, it is desirable that the correction value fitted to seven-color print should be set so as to correct the difference (discrepancy) between the nozzle rows for ejecting inks of colors in which the image quality difference between the image printed when the difference between the dot formation position in the go way and that in the return way occurred and the image to be essentially printed based on the image data in seven-color print, for example, the tint difference is most conspicuous. Thus, the correction value in seven-color print is determined based on the print correction pattern for seven-color print formed in inks ejected from the nozzle rows for ejecting light magenta (LM) ink and light cyan (LC) ink, namely, the nozzle rows R2 and R3 so that the difference between the ejection positions of inks ejected from the nozzle rows R2 and R3 becomes the minimum.

On the other hand, it is desirable that the correction value fitted to four-color print should be set so as to correct the difference between the dot formation positions in the go way and that in the return way, of inks of the same color ejected from different nozzle rows in four-color print. Thus, the correction value in four-color print is determined based on the print correction pattern formed in ink ejected from the nozzle rows R1 and R8 for ejecting yellow (Y), the nozzle rows R2 and R7 for ejecting magenta (M) ink, the nozzle rows R3 and R6 for ejecting cyan (C) ink, or the nozzle rows R4 and R5 for ejecting black (K) ink so that the difference between the ejection positions of inks ejected from the nozzle rows becomes the minimum. In the embodiment, the difference between the ink ejection positions of the nozzle rows R2 and R7 for ejecting magenta (M) ink in which the ink ejection position difference is most conspicuous is corrected.

Figure 10:
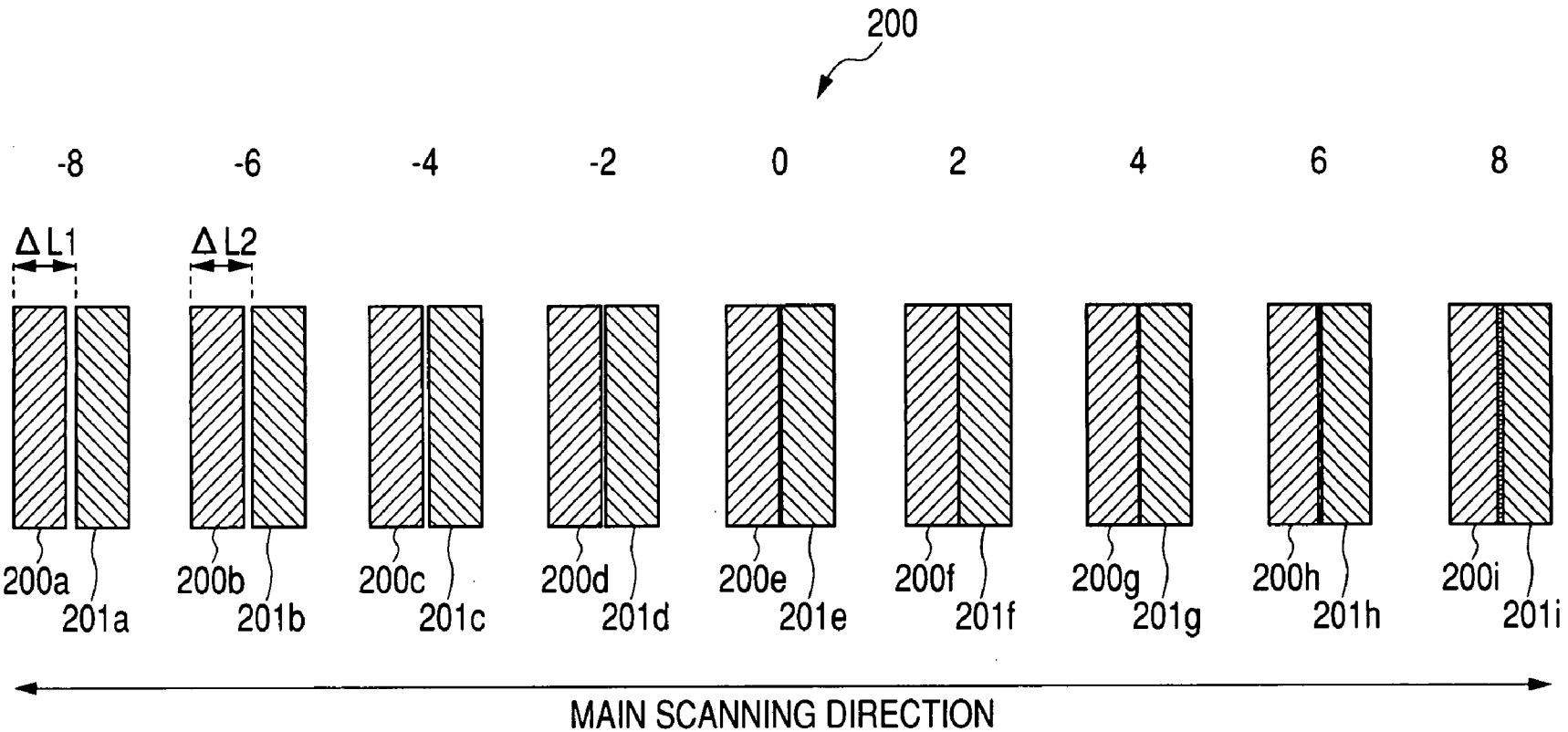
FIG. 10 is a drawing to show an example of a print correction pattern printed in the embodiment of the invention.

Next, an outline of the print correction pattern used in the seven-color print mode or the four-color print mode will be discussed with reference to FIG. 10. FIG. 10 is a conceptual drawing of the printed print correction pattern. As shown here, print correction pattern 200 has eight rectangular block pairs printed with an appropriate spacing in the main scanning direction. In the description that follows, the print correction pattern for the seven-color print mode is taken as an example.

Blocks 200*a* to 200*i* corresponding to a first pattern group are patterns printed in light magenta (LM) ink in the go way of the print head 12 (Unid direction) and are printed with a given spacing. Blocks 201*a* to 201*i* corresponding to a second pattern group are patterns printed in light cyan (LC) ink in the return way of the print head 12 (Bid direction). The blocks 201*a* to 201*i* are printed so that the respective block widths (the number of dots in the scanning direction) of the blocks 201*a* to 201*i* increase in a direction from left side blocks to right side blocks although the same ejection timing is applied to all blocks unlike the case in the related art. That is, in the example, the blocks 201*a* to 201*i* are printed so that the width of each block increases one dot (=1/1440 inches) at a time.

As the blocks 201*a* to 201*i* are thus printed with the block width increased, for example, the difference between distance ΔL1 from the left end of the block 200*a* to the left end of the block 201*a* and distance ΔL2 from the left end of the block 200*b* to the left end of the block 201*b* becomes ΔL1−ΔL2=1/1440 inches. Likewise, the difference between distance ΔL2 from the left end of the block 200*b* to the left end of the block 201*b* and distance ΔL3 (not shown) from the left end of the block 200*c* to the left end of the block 201*c* becomes ΔL2−ΔL3=1/1440 inches. Since this also applies to other blocks, the spacing between the paired blocks decreases gradually from left to right.

The numerals of −8 to 8 printed above the block pairs are numerals to indicate the block pair corresponding to the appropriate correction amount.

Such a print correction pattern is printed on print paper P, the block pair wherein the opposed sides are the nearest is found, and the numeral printed above the block pair is selected, whereby the optimum correction amount in the seven-color print mode can be obtained. In the example in FIG. 10, the opposed sides of the blocks 200*f* and 201*f* are the nearest. On the other hand, a gap occurs between the blocks 200*e* and 201*e*, and the blocks 200*g* and 201*g* overlap one another. Therefore, the numeral 2 printed above the blocks 200*f* and 201*f* is selected, and the correction amount is determined according to processing described later.

Next, the detailed operation of the embodiment is as follows:

If the user operates the input unit 99 of the computer 90 shown in FIG. 3 to enter a command for starting an application program for printing the print correction pattern (simply, the application program), the CPU 91 reads and executes the application program stored in the HDD 94 or the external storage unit 100. Consequently, the application program generates predetermined print signal PS and supplies the print signal PS through the I/F 96 to the printer 22.

In the printer 22, the CPU 41 of the control circuit 40 receives the print signal PS through the I/F dedicated circuit 50 and executes the operation responsive to an instruction from the application program executed in the computer 90.

That is, the CPU 41 sends a control signal to the motor drive circuit 54 for controlling the paper feed motor 23 to suck only one sheet of print paper P into the printer 22 and then controls the carriage motor 24 for moving the print head 12 to the home position (for example, the right end in FIG. 1).

Next, the CPU 41 references the information stored in the ROM 14 of the ink cartridge and determines which of the four-color and seven-color print modes the mounted ink cartridge corresponds to. If the mounted ink cartridge corresponds to the seven-color print mode, light magenta (LM) ink and light cyan (LC) ink having the largest effect on the image quality are selected as ink for drawing the print correction pattern. If the mounted ink cartridge corresponds to the four-color print mode, magenta (M) ink high in visibility is selected. It is desirable that magenta (M) should be used because yellow (Y) is low in visibility and is not much involved in degradation of the image quality if yellow (Y) causes a difference in printing.

Figure 11:
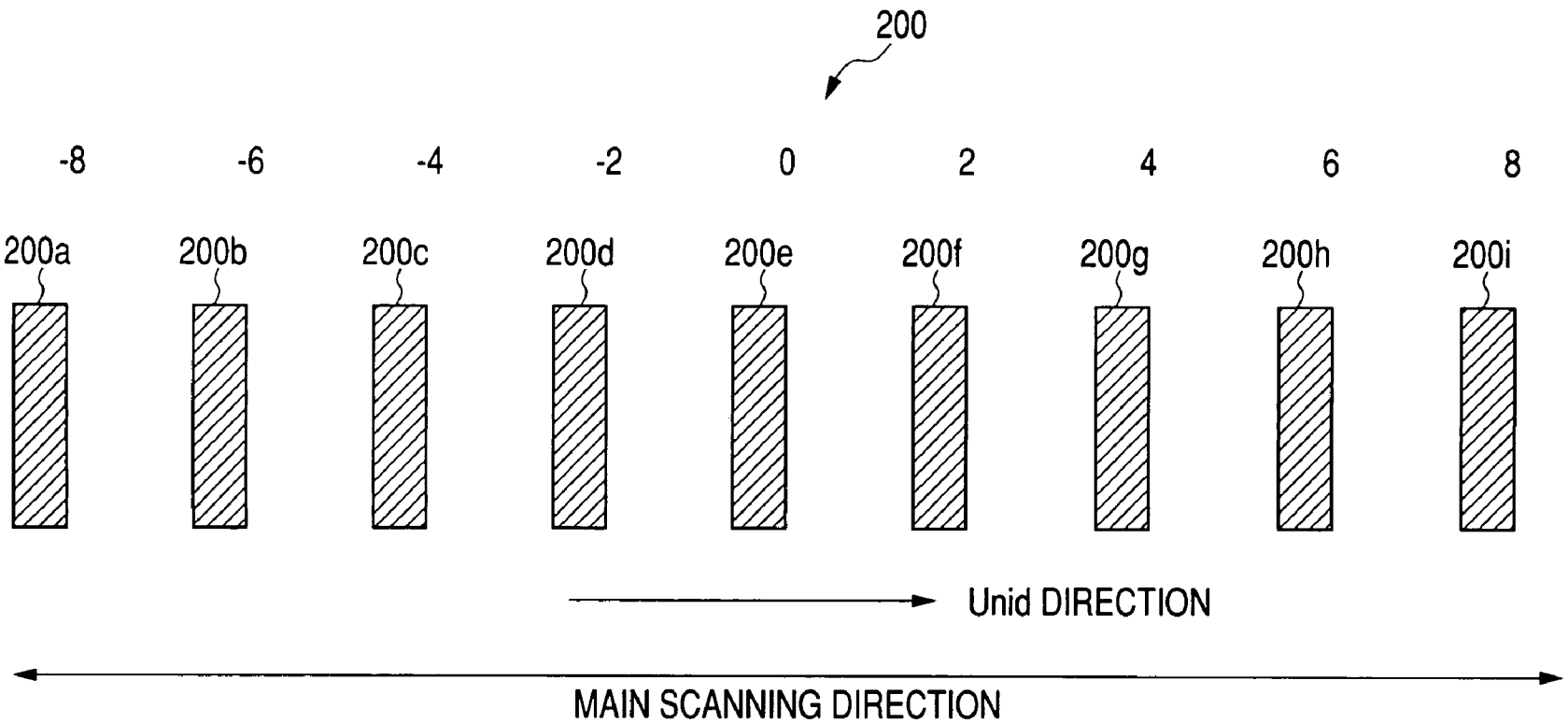
FIG. 11 is a drawing to show a print method of the print correction pattern shown in FIG. 10.

Subsequently, the CPU 41 sends a control signal to the CG 45 for generating the characters corresponding to the numerals −8 to 8 for indicating the block pairs and causes the characters to be printed with a predetermined spacing in the lateral direction of print paper P. Consequently, the numerals −8 to 8 shown in FIG. 11 are printed on the print paper P.

Subsequently, the CPU 41 sends a control signal to the motor drive circuit 54 for controlling the paper feed motor 23 to feed the print paper P by a predetermined amount.

Subsequently, the CPU 41 sends a control signal to the motor drive circuit 54 for controlling the carriage motor 24 to move the print head unit 60 to the left end in the figure. While the print head unit 60 is moved from left to right (in the Unid direction), the CPU 41 sends a control signal to the head drive circuit 52 for consecutively ejecting light magenta (LM) ink every predetermined spacing for drawing the blocks 200*a* to 200*i* in this order. Consequently, the pattern as shown in FIG. 11 is obtained. In the embodiment, blocks of the same shape each becoming a rectangle as a whole are printed on the print paper P.

Figure 12:
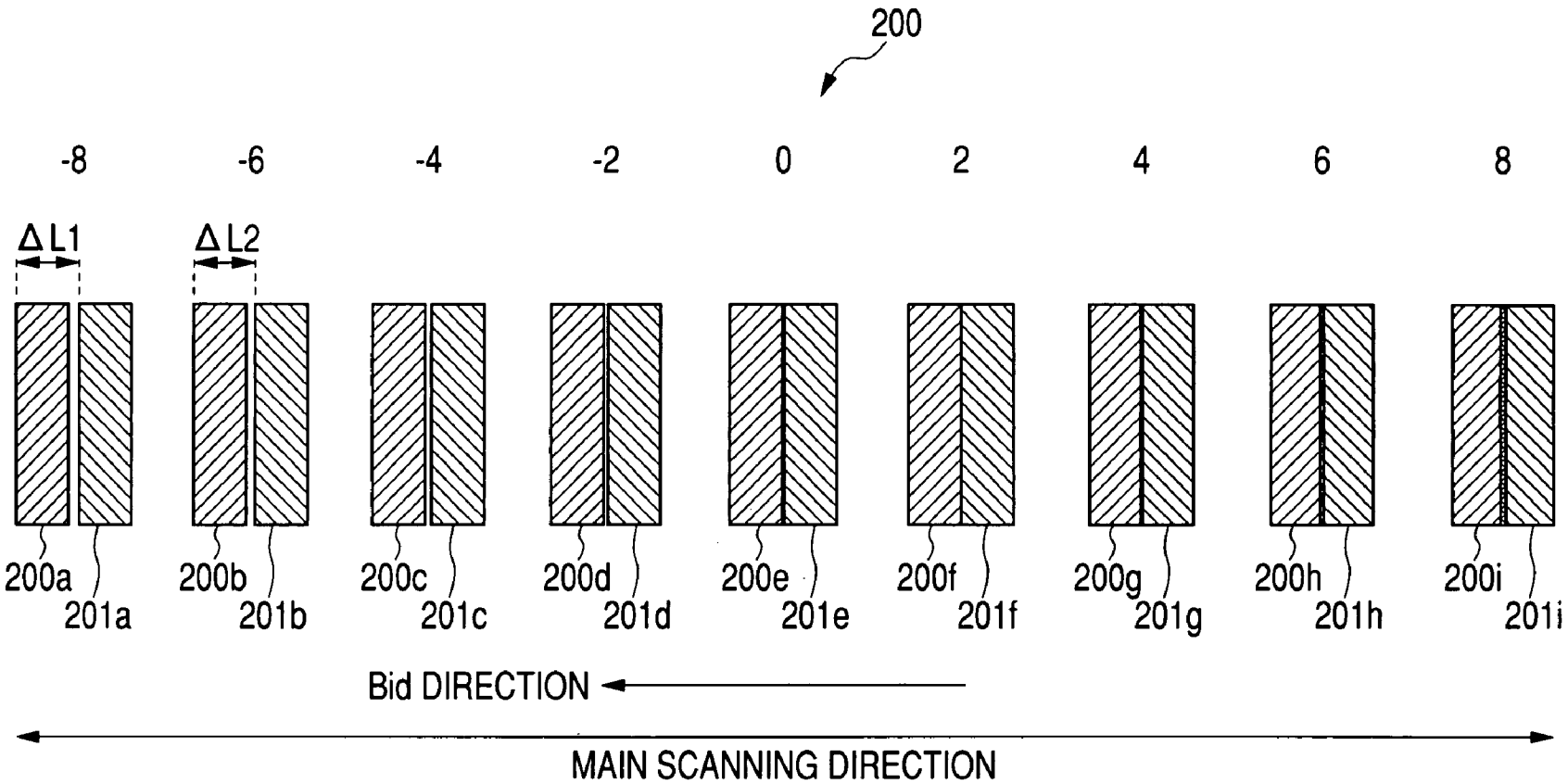
FIG. 12 is a drawing to show another drawing method of the print correction pattern shown in FIG. 10 and is a drawing to describe a drawing method of one block of each of block pairs.

Subsequently, the CPU 41 sends a control signal to the motor drive circuit 54 for controlling the carriage motor 24 to move the print head unit 60 to the right end in the figure. While the print head unit 60 is moved from right to left (in the Bid direction), the CPU 41 sends a control signal to the head drive circuit 52 for consecutively ejecting light cyan (LC) ink every predetermined spacing for drawing the blocks 201*i* to 201*a* so as to shorten the length of the short side of each block in order one dot at a time. Consequently, the pattern as shown in FIG. 12 is obtained. Although the print instruction supplied from the computer 90 is set so that the opposed long sides of the blocks 200*e* and 201*e* overlap one another, if the correction amount is not appropriate, a predetermined difference occurs.

Figure 13:
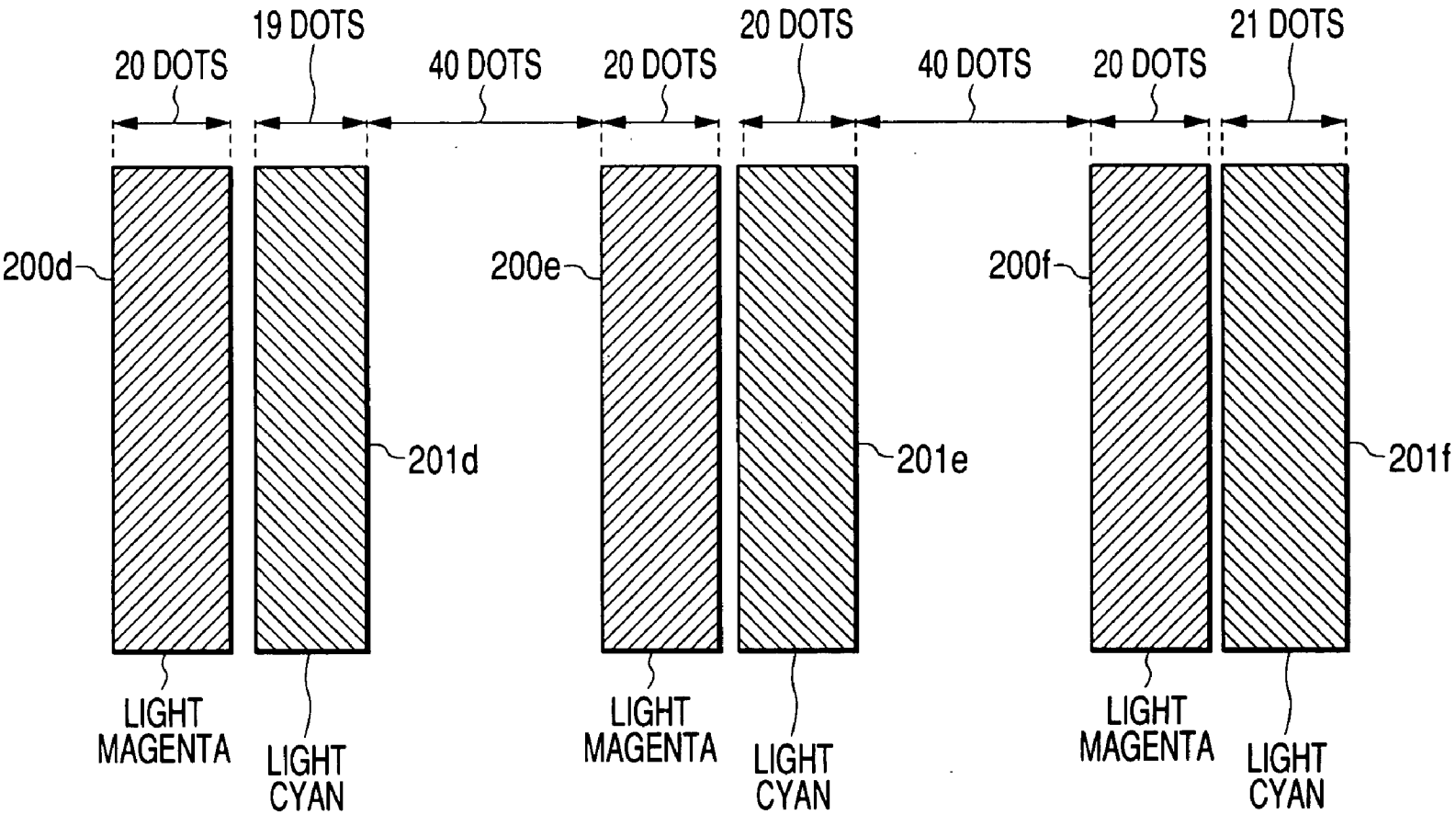
FIG. 13 is a drawing to show another drawing method of the print correction pattern shown in FIG. 10 and is a drawing to describe a drawing method of the other block of each of block pairs.

FIG. 13 is a drawing to describe details of some blocks drawn in the embodiment. In this example, the blocks 200*d* to 200*f* each having a 20-dot width are drawn in light magenta (LM). The block 201*d* having a 19-dot width, the block 201*e* having a 20-dot width, and the block 201*f* having a 21-dot width are drawn in light cyan (LC). The blocks 201*d* and 200*e* are drawn with 40-dot spacing and the blocks 201*e* and 200*f* are drawn with 40-dot spacing. For other blocks, each of the blocks 200*a* to 200*i* has a 20-dot width and the blocks 201*a* to 201*i* have a 16-dot width to a 24-dot width.

Figure 14:
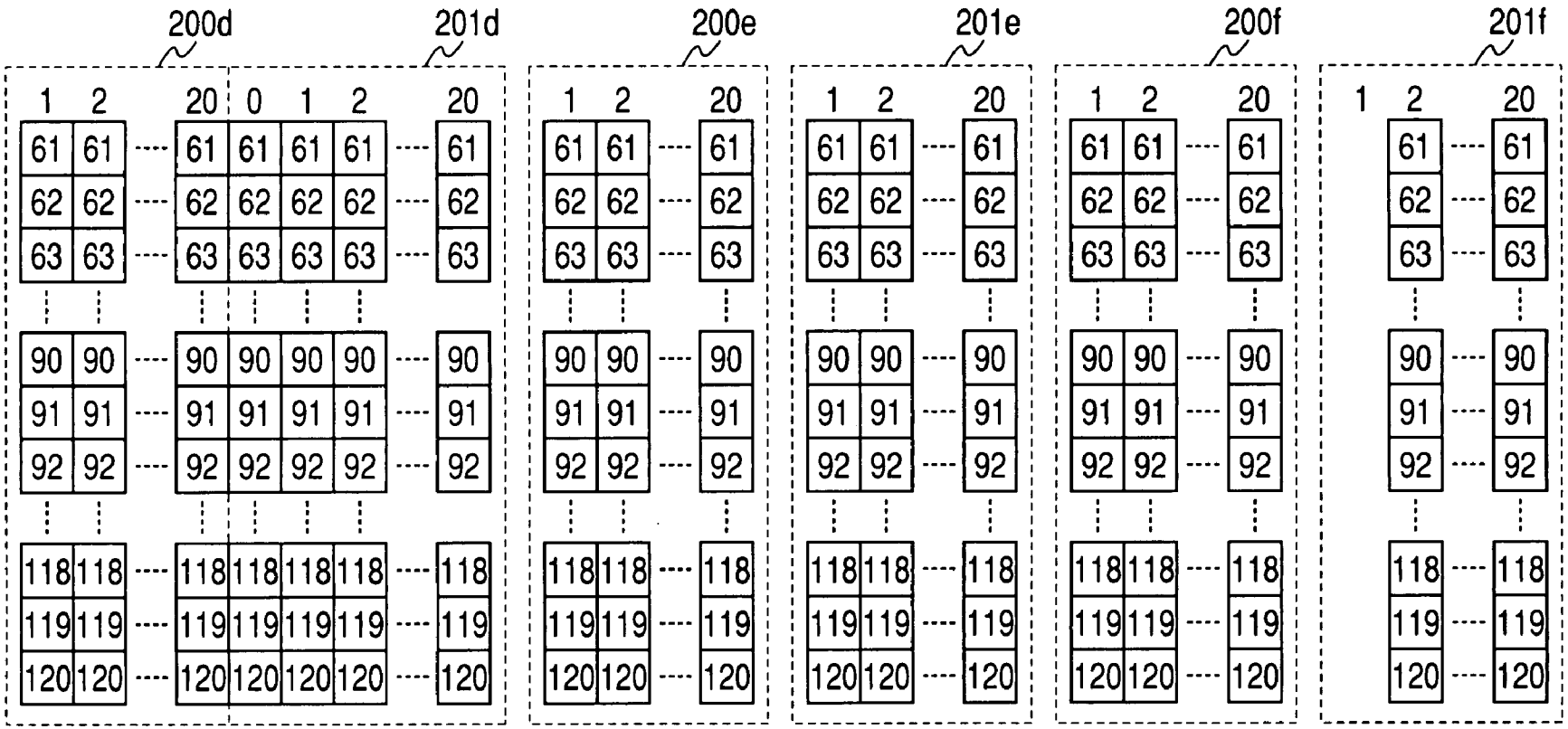
FIG. 14 is a drawing to show nozzles for drawing the print correction pattern shown in FIG. 10.

FIG. 14 is a drawing to show an example of nozzle rows used at the embodiment. As shown in FIG. 6, each nozzle row has 180 nozzles of $N_1$ to $N_{180}$. To draw a block, the nozzles $N_{61}$ to $N_{120}$ positioned at the center corresponding to one third of the total are used to print the block, as shown in FIG. 14. The block 201*d* is printed so as to have the 19-dot width; the block 201*e* is printed so as to have the 20-dot width; and the block 201*f* is printed so as to have the 21-dot width. The purpose of drawing blocks using some of the nozzles at the center is to prevent a difference from occurring between inclinations in the go way and the return way and an error from occurring in the tip portion of the block if the print head 12 is mounted having a difference relative to the main scanning direction (namely, the nozzles $N_1$ to $N_{180}$ are not completely vertical to the main scanning direction) and having looseness rather than being firm. The nozzles at one end rather than at the center or all nozzles of each nozzle row may be used to draw each block.

Upon completion of printing all blocks, the CPU 41 sends a control signal to the motor drive circuit 54 for controlling the carriage motor 24 to move the print head unit 60 to the home position, and also controls the paper feed motor 23 for ejecting the print paper P.

When the print correction pattern thus printed is referenced and the block pair with the opposed sides being the nearest is found and the numeral assigned to the block pair is entered by the user operating the input unit 99 of the computer 90. In a result, the data indicating the correction amount corresponding to the input numeral is supplied through the I/F 96 to the printer 22. In the example in FIG. 2, the blocks 200*f* and 201*f* are the nearest and thus 2 is selected. Consequently, it is found that the Bid print position shifts to the right by 1/1440 inches as compared with the Unid print position, and thus the correction amount corresponding to 1/1440 inches is supplied through the I/F 96 to the printer 22.

In the printer 22, the CPU 41 inputs the data through the I/F dedicated circuit 50 and stores the data in a predetermined area of the EEPROM 46. The data thus stored in the EEPROM 46 is supplied to the correction circuit 153 for the later use as the correction amount in the return way direction to print in the seven-color print mode. Thus, at least the ejection timings of light magenta (LM) and light cyan (LC) frequently used to print a natural image can be set optimally and a high-quality image can be provided. The determined correction amount is also used to determine another nozzle correction amount. That is, the correction amount for each type of ink is obtained based on the mechanical positional relationships among the nozzle rows R1 to R8.

According to the embodiment described above, the blocks are printed increasing or decreasing the width (the number of dots) of at least one block of each block pair in the scanning direction, so that the need for changing the correction amount in each block is eliminated and thus it is made possible to print the print correction pattern rapidly.

Figure 22:
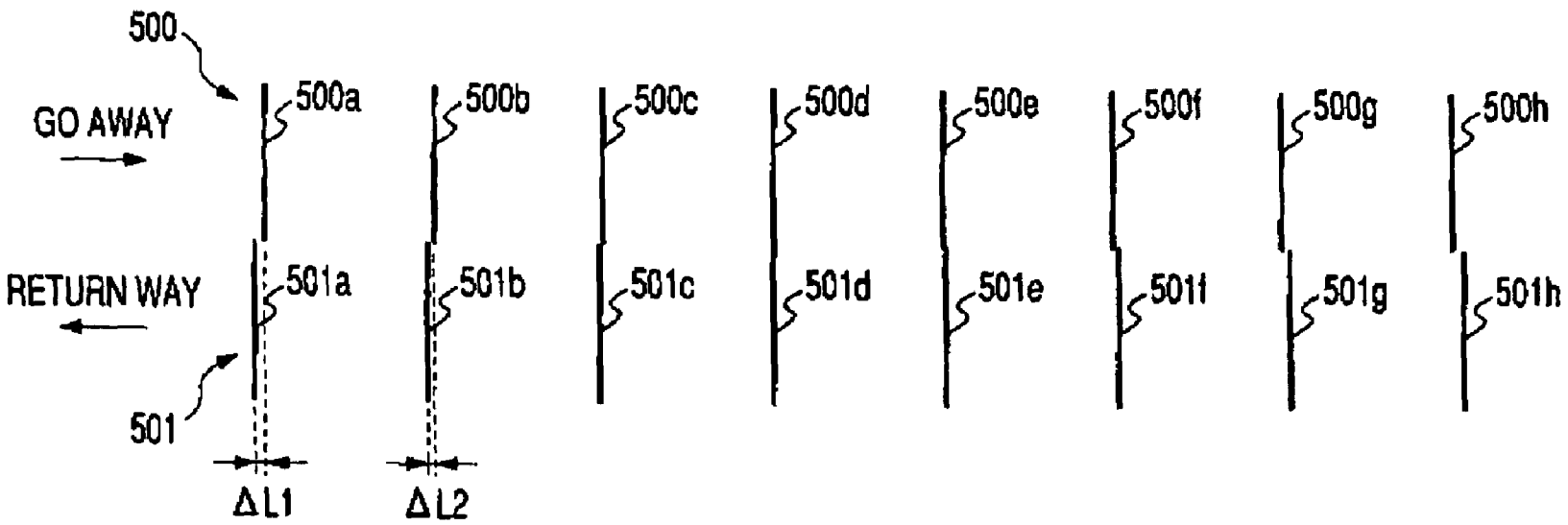
FIG. 22 Prior Art
FIG. 22 is a drawing to show a print correction pattern in a related art.

The correction amount is found using block pairs. Thus, as compared with the print correction pattern in the related art shown in FIG. 22, the visibility is improved, whereby it is made possible to find the correction amount precisely.

Figure 15:
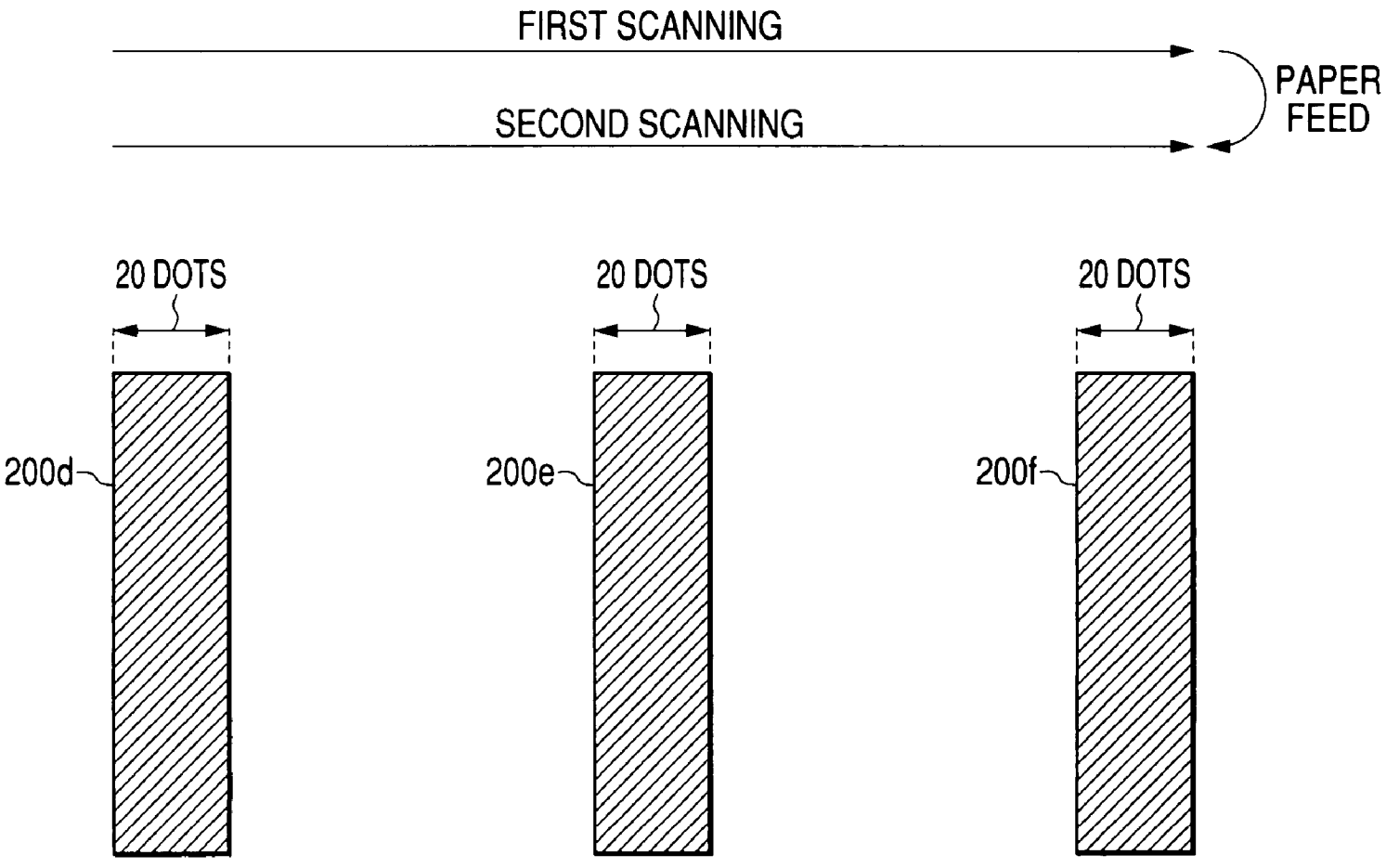
FIG. 15 is a drawing to show another drawing method of the print correction pattern shown in FIG. 10 and is a drawing to describe a drawing method of one block of each of block pairs.
Figure 16:
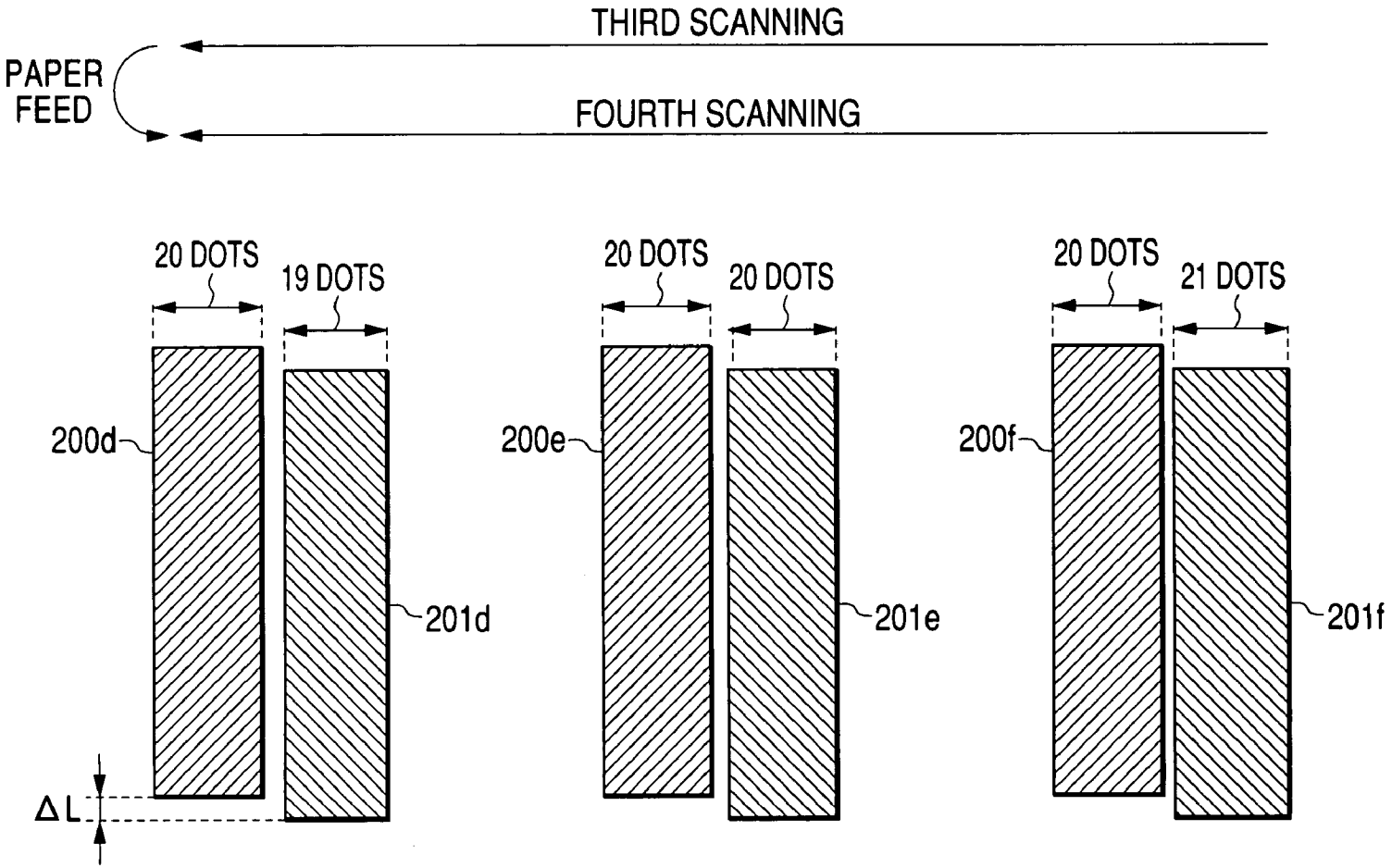
FIG. 16 is a drawing to show another drawing method of the print correction pattern shown in FIG. 10 and is a drawing to describe a drawing method of the other block of each of block pairs.

In the embodiment described above, the correction blocks are drawn by one reciprocating scanning, but can also be drawn by more than one scanning. FIGS. 15 and 16 are drawings to show an example of drawing blocks by scanning twice.

In the example in FIGS. 15 and 16, for simplicity, only blocks 200*d* to 200*f* and blocks 201*d* to 201*f* are shown. As shown in FIG. 15, in the first scanning, the blocks 200*d* to 200*f* are drawn by scanning in the Uind direction and paper is fed by a predetermined amount and then the blocks 200*d* to 200*f* are again drawn by the second scanning in the Uind direction.

Subsequently, as shown in FIG. 16, in the third scanning as the return way of the second scanning, the blocks 201*d* to 201*f* are drawn by scanning in the Bid direction. Then, paper is fed by a predetermined amount and then the blocks 201*d* to 201*f* are again drawn by the fourth scanning in the return direction. Since the blocks are drawn with paper feed control, each block pair has a shift of ΔL relative to the subscanning direction (corresponding to one paper feed amount).

According to the drawing method, as compared with drawing the blocks by one scanning, the ink density of the drawn pattern can be improved by overwriting, so that it is made possible to more enhance the visibility.

In the embodiments described above, the dot pitch (=1/1440 inches) is equal to the minimum unit of the correction amount. If the dot pich and the correction amount are different (for example, dot pitch>minimum unit of correction amount), a print correction pattern can also be created.

Figure 17:
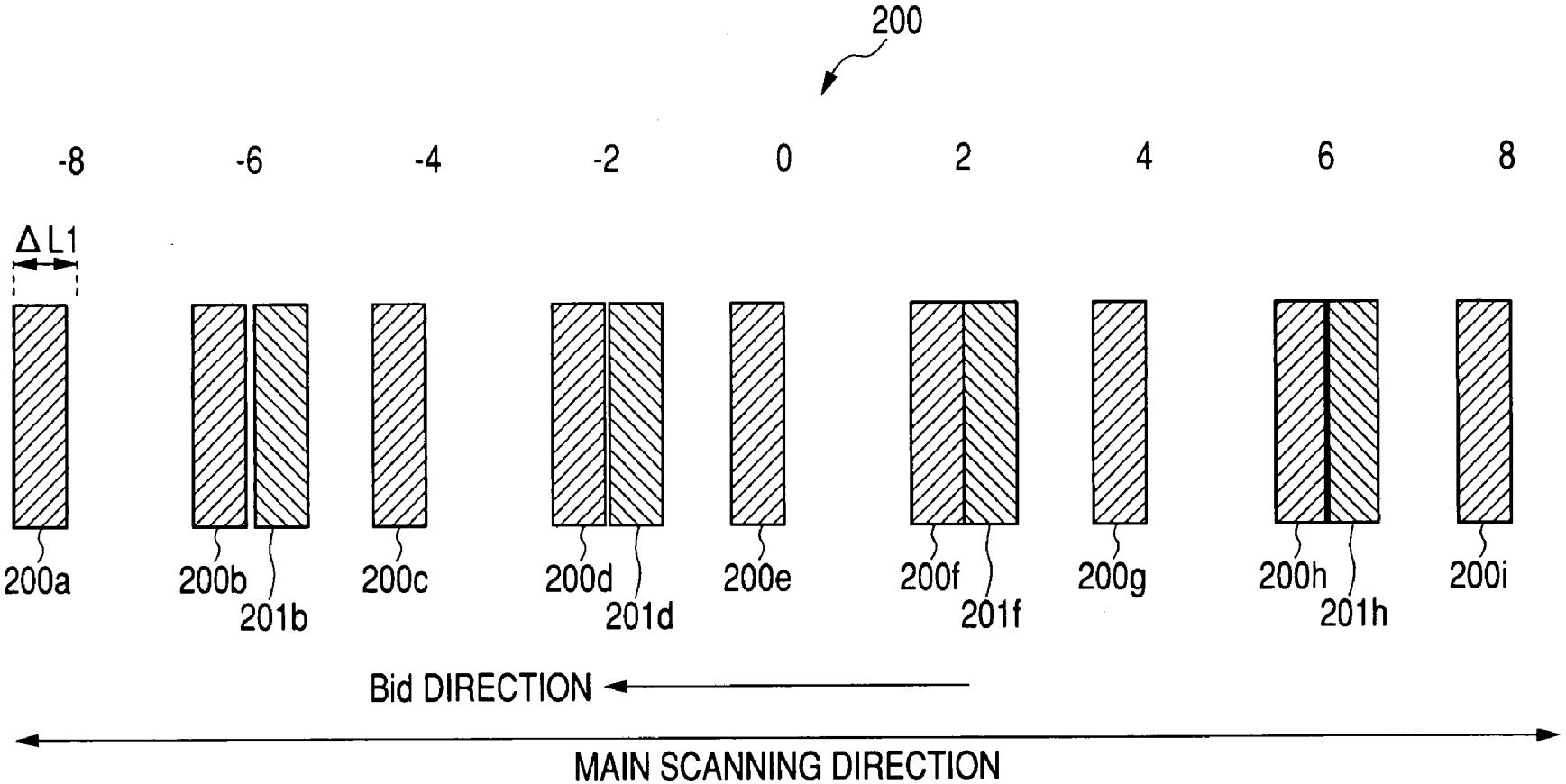
FIG. 17 is a drawing to show another drawing method of the print correction pattern shown in FIG. 10 and is a drawing to describe a drawing method of one block of each of block pairs when the dot pitch is larger than the minimum unit of the correction amount.
Figure 18:
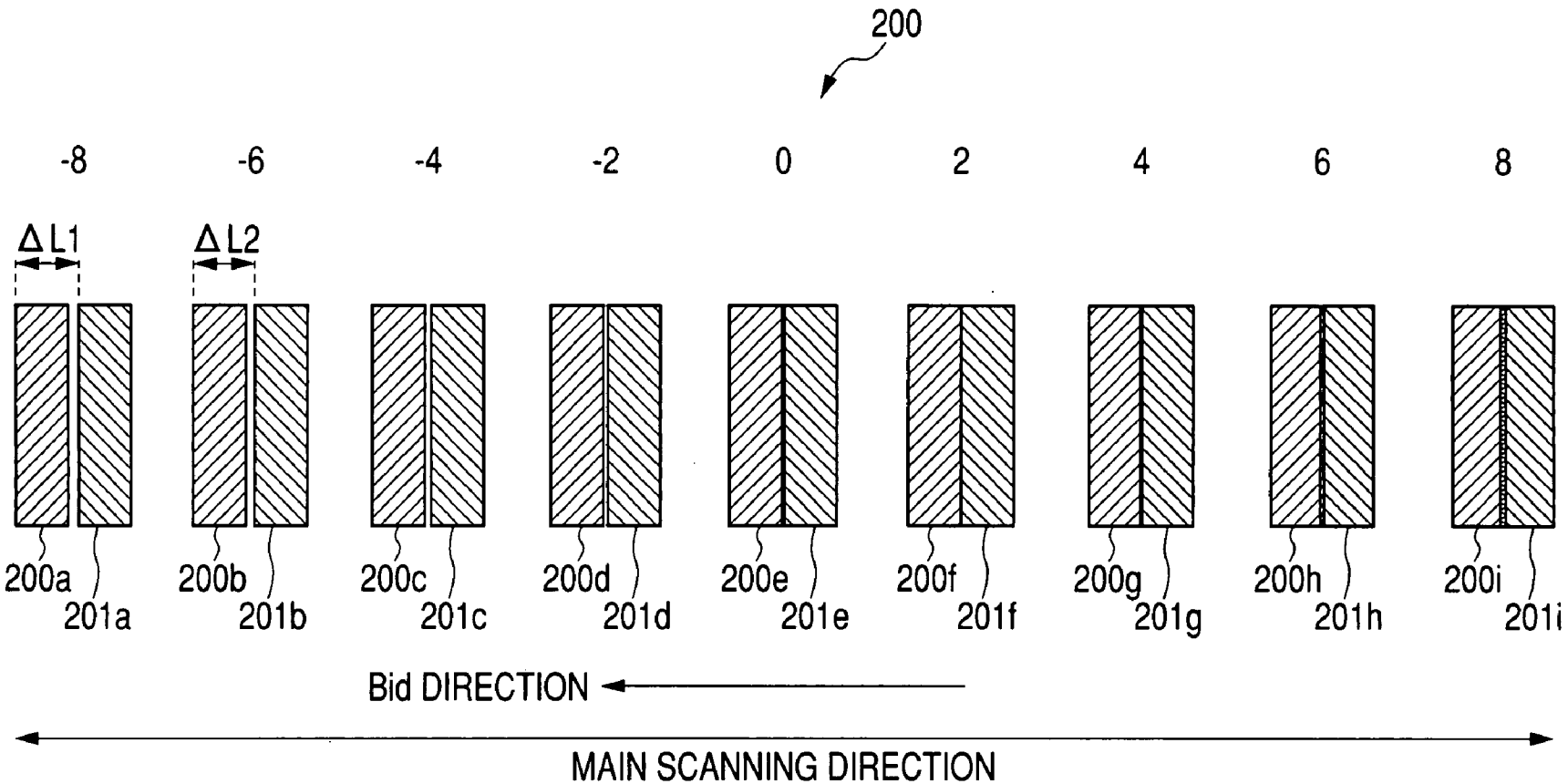
FIG. 18 is a drawing to show another drawing method of the print correction pattern shown in FIG. 10 and is a drawing to describe a drawing method of the other block of each of block pairs when the dot pitch is larger than the minimum unit of the correction amount.

FIGS. 17 and 18 are drawings to describe a drawing method of a print correction pattern when the dot pitch is 1/720 inches and the minimum unit of the correction amount is 1/1440 inches. The case where such a relationship occurs is, for example, the case where the ink ejection period is prolonged if the ink amount is lessened in a printer wherein the ink droplet amount can be varied for printing. In such a case, first, blocks 200*a* to 200*i* are drawn by scanning in the Unid direction, as shown in FIG. 11.

Next, as the first scanning is executed in the Bid direction, blocks 201*h*, 201*f*, 201*d*, and 201*b* are drawn in order while the block width is changed one dot at a time (1/720 inches), as shown in FIG. 17.

Subsequently, the correction amount is shifted 1/1440 inches, namely, the print position is shifted to the left by 1/1440 inches from the print position in the-first scanning and as the second scanning is executed, blocks 201*i*, 201*g*, 201*e*, 201*c*, and 201*a* are drawn in order while the block width is changed one dot at a time (1/720 inches).

Consequently, the blocks 201*h*, 201*f*, 201*d*, and 201*b* provided by the first scanning and the blocks 201*i*, 201*g*, 201*e*, 201*c*, and 201*a* provided by the second scanning have each a shift of 1/1440 inches, so that a print correction pattern as shown in FIG. 18 can be provided.

In the example in FIGS. 17 and 18, the ratio between the dot pitch and the minimum unit of the correction amount is 2:1; however, in any other case, a similar print correction pattern to that in FIG. 18 can also be provided by a similar method to that described above.

In the description of the embodiments, the seven-color print mode is taken as an example; in the four-color print mode, the blocks 200*a* to 200*i* may be printed using the nozzle row 72 in the Unid direction and the blocks 201*a* to 201*i* may be printed using the nozzle row 76 in the Bid direction, for example.

In the embodiments, in the seven-color print mode, the print correction pattern is printed using light cyan (LC) and light magenta (LM); in the four-color print mode, the print correction pattern is printed using magenta (M). However, the print correction pattern may be printed in any other color (for example, black (K)) using a different nozzle row or can also be printed in the same color using the same nozzle row. For example, to print characters, etc., black (K) is much used and thus if the print correction pattern is printed using black and the correction amount is found, characters can be printed at good resolution.

Next, a print correction pattern that can be shared between the seven-color print mode and the four-color print mode, which will be hereinafter referred to as shared print correction pattern, will be discussed with reference to FIGS. 19 to 21.

Figure 19:
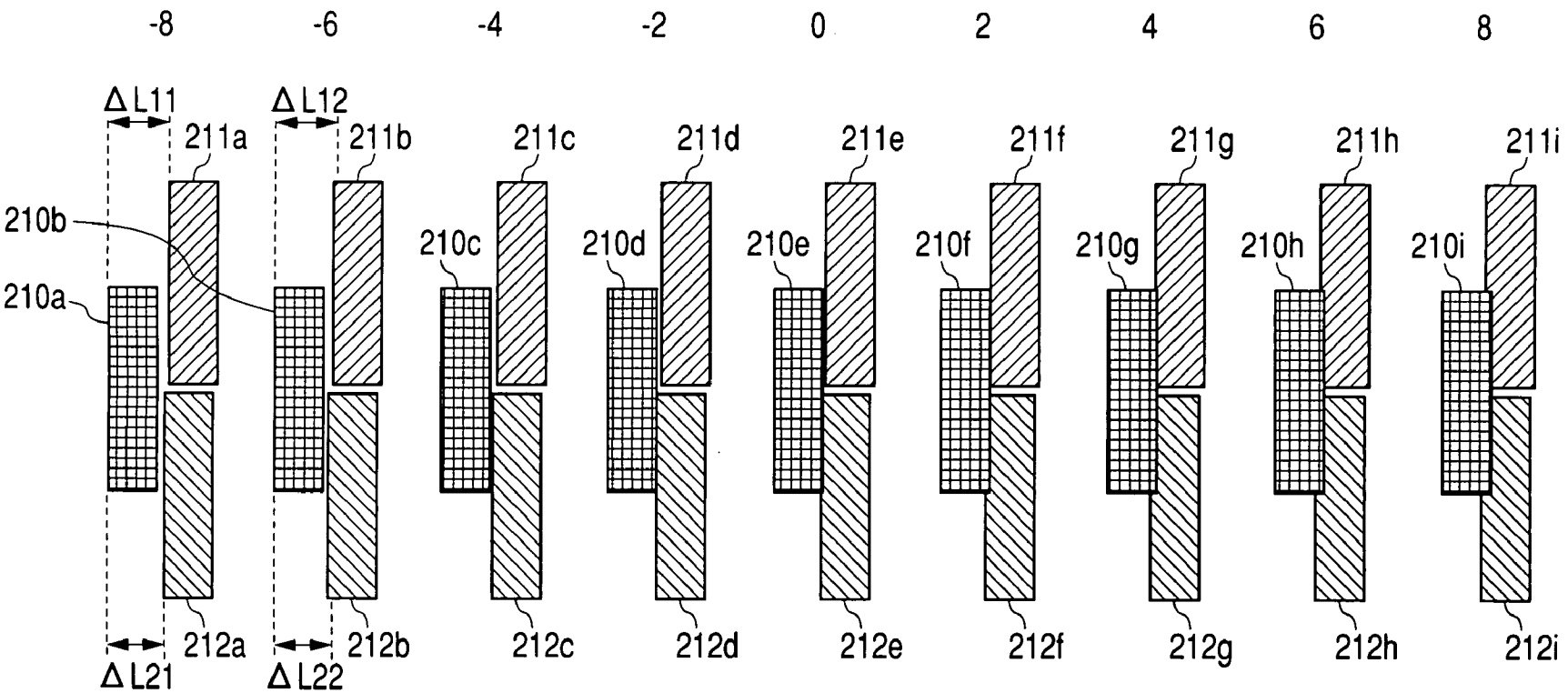
FIG. 19 is a drawing to show another example of print correction pattern printed in the embodiment of the invention.

FIG. 19 is a drawing to show an example of the shared print correction pattern. As shown in the figure, the shared print correction pattern has blocks 210*a* to 210*i* corresponding to a first pattern group, blocks 211*a* to 211*i* corresponding to a second pattern group, and blocks 212*a* to 212*i* corresponding to a third pattern group. The blocks 210*a* to 210*i* are blocks printed with the nozzle rows used in common in printing the print correction pattern in the seven-color print mode and that in the four-color print mode. The blocks 211*a* to 211*i* are blocks printed with the nozzle rows used in printing the print correction pattern in the seven-color print mode. The blocks 212*a* to 212*i* are blocks printed with the nozzle rows used in printing the print correction pattern in the four-color print mode.

The nozzle rows R2 and R3 are used to draw the print correction pattern in the seven-color print mode. The nozzle rows R2 and R6 are used to draw the print correction pattern in the four-color print mode. Therefore, the nozzle row R2 is used in common and thus the blocks 210*a* to 210*i* are drawn with the nozzle row R2. Since the nozzle row R3 is used in the seven-color print mode and the nozzle row R6 is used in the four-color print mode, the blocks 211*a* to 211*i* are drawn with the nozzle row R3 and the blocks 212*a* to 212*i* are drawn with the nozzle row R6. The blocks 210*a* to 210*i* are printed in scanning in the Unid direction and the blocks

211*a* to 211*i* and the blocks 212*a* to 212*i* are printed at the same time in scanning in the Bid direction.

Figure 20:
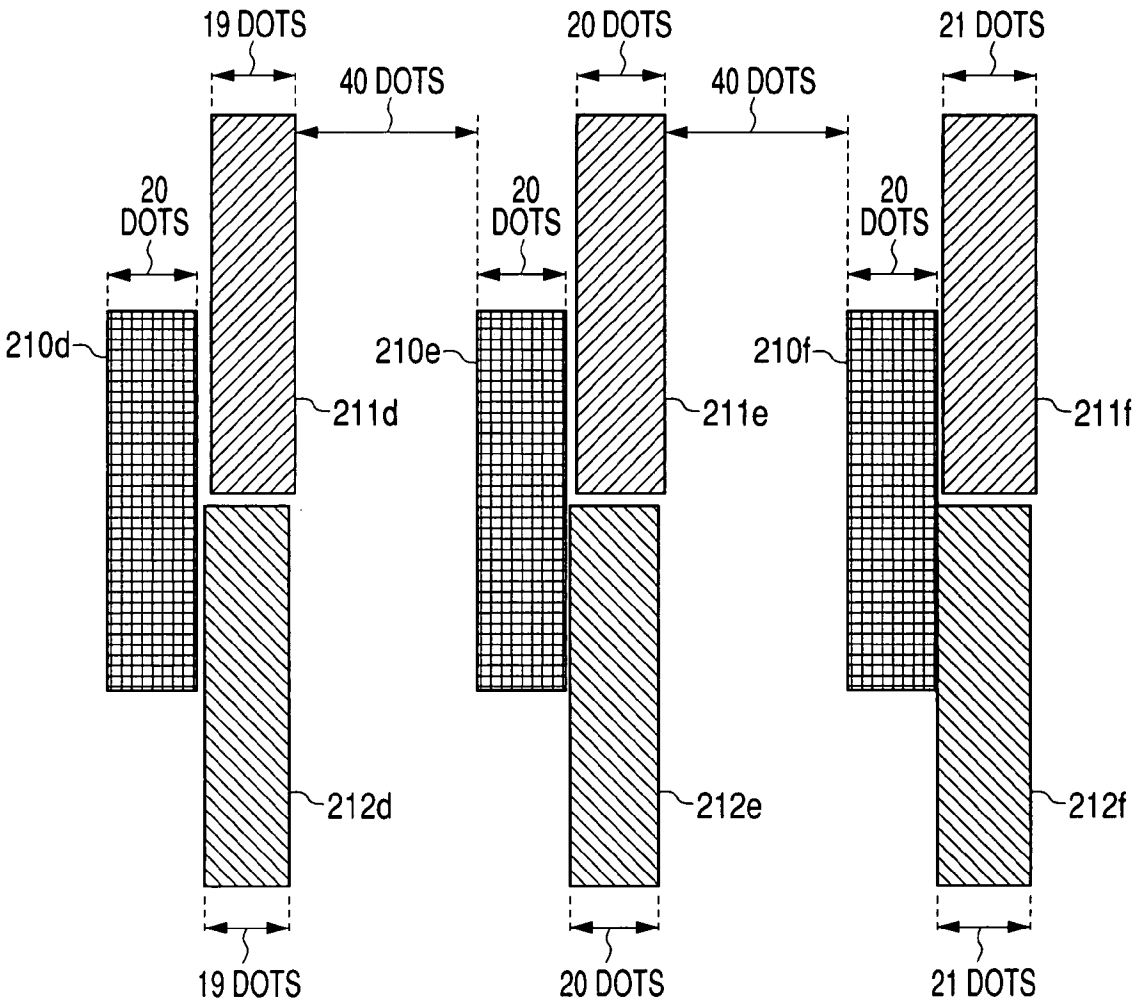
FIG. 20 is a drawing to show the print correction pattern shown in FIG. 19 in detail.

FIG. 20 is a drawing to show a part of the print correction pattern in detail. As shown in the figure, the blocks 210*d* to 210*f* have each a 20-dot width in the main scanning direction. The blocks 211*d* to 211*f* and the blocks 212*d* to 212*f* have a 19-dot width, a 20-dot width, and a 21-dot width in the main scanning direction respectively. The block 210*e* (210 is placed with a 40-dot spacing from the block 211*d* (211*e*) or the block 212*d* (212*e*) placed at the left. For other blocks, the blocks 210*a* to 210*i* have each a 20-dot width and the blocks 211*a* to 211*i* and the blocks 212*a* to 212*i* have a 16-dot width to a 24-dot width. The blocks 210*b* to 210*i* are placed with a 40-dot spacing from the blocks 211*a* to 211*h* or the blocks 212*a* to 212*h* placed at the left.

Figure 21:
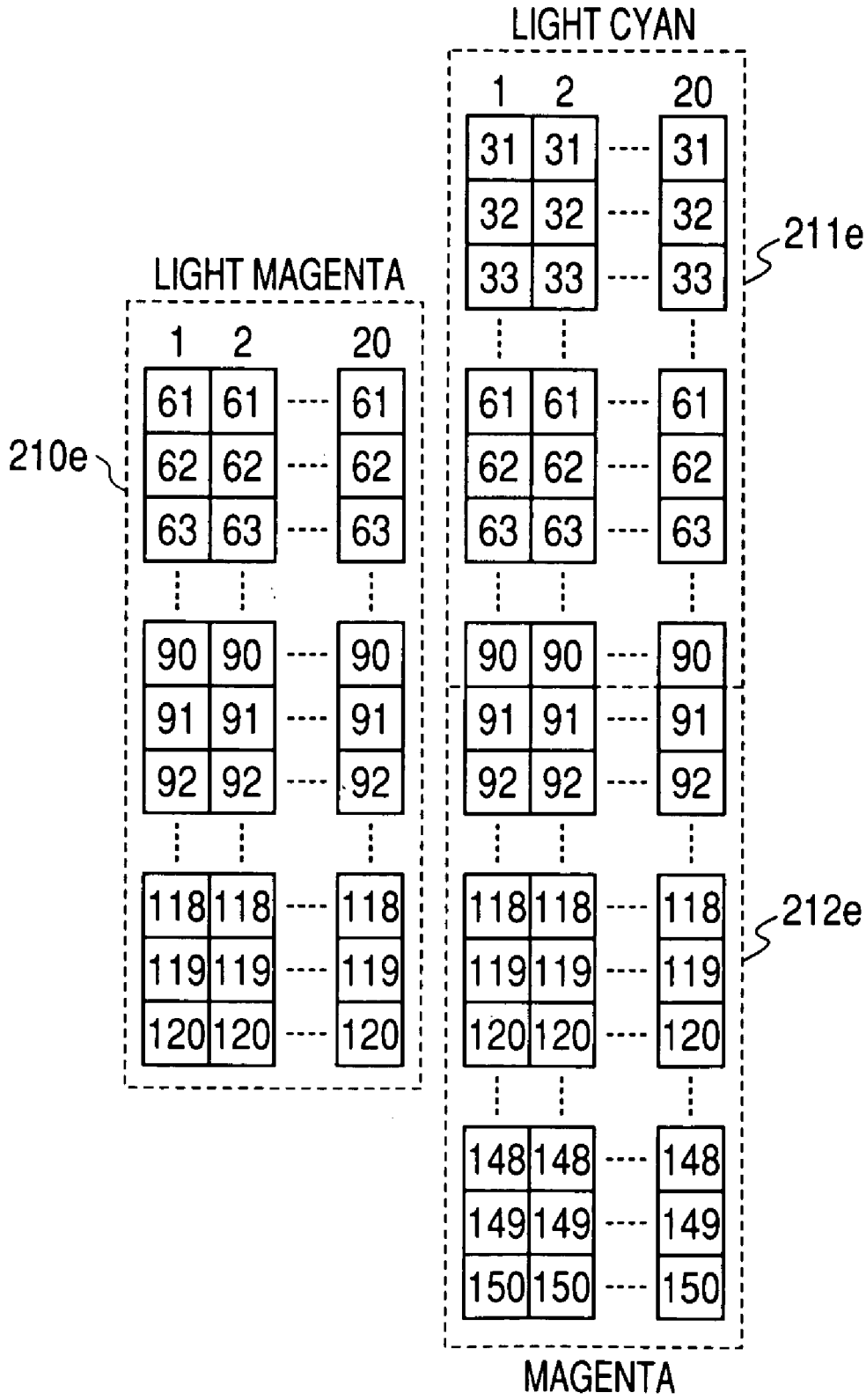
FIG. 21 is a drawing to show nozzles for drawing the print correction pattern shown in FIG. 19.

To draw the blocks, as shown in FIG. 21, first the blocks 210*a* to 210*i* are drawn with the nozzles $N_{61}$ to $N_{120}$ in the vicinity of the center of the nozzle row R2 while scanning in the Unid direction. Next, the blocks 211*a* to 211*i* are drawn with the nozzles $N_{31}$ to $N_{90}$ of the nozzle row R2 while scanning in the Bid direction and at the same time, the blocks 212*a* to 0.212*i* are drawn with the nozzles $N_{91}$ to $N_{150}$ the nozzle row R6. Therefore, in the example, the shared print correction pattern shown in FIG. 19 is printed as one scanning is executed in the Unid direction and one scanning is executed in the Bid direction. The numerals shown in the upper portion of FIG. 19 are used when a predetermined correction amount is indicated, as with the case described above.

Referring to the shared print correction pattern, in the seven-color print mode, the numeral assigned to the block pair wherein the opposed sides are the nearest is specified among the block pairs of the blocks 210*a* to 210*i* and the blocks 211*a* to 211*i*. In the four-color print mode, the numeral assigned to the block pair wherein the opposed sides are the nearest is specified among the block pairs of the blocks 210*a* to 210*i* and the blocks 212*a* to 212*i*.

In FIG. 19, in the seven-color print mode, the opposed sides of the blocks 210*f* and 211*f* are the nearest and therefore the numeral 2 assigned above the block pair is selected. In the four-color print mode, the opposed sides of the blocks 210*d* and 212*d* are the nearest and therefore the numeral −2 assigned above the block pair is selected.

The numeral corresponding to each mode thus selected is stored in the EEPROM 46 of the printer 22, as with the case described above, and the information stored in the ROM 14 is referenced, whereby if the mounted ink cartridge is for the seven-color print mode, the correction amount corresponding to the numeral (2) for the seven-color print mode is supplied to the correction circuit 153 and print is executed based on the correction amount optimum for the seven-color print mode. On the other hand, if the mounted ink cartridge is for the four-color print mode, the correction amount corresponding to the numeral (−2) for the four-color print mode is supplied to the correction circuit 153 and print is executed based on the correction amount optimum for the four-color print mode.

In the embodiment shown in FIG. 19, it is also possible to print more than once as shown in FIGS. 15 and 16 or print the blocks 211*a* to 211*i* separately twice and the blocks 212*a* to 212*i* separately twice.

As described above, to use the shared print correction pattern, it is made possible to make a correction using the same print correction pattern for both the seven-color print mode and the four-color print mode, so that it is made possible to reduce the time consumed for correction as the time required for print is reduced.

Since the blocks are printed increasing or decreasing the width (the number of dots) of at least one block of each block pair in the scanning direction, so that the need for changing the correction amount in each block is eliminated and thus it is made possible to print the print correction pattern rapidly, as with the print correction pattern previously described with reference to FIG. 10. Since the blocks having a predetermined width in the main scanning direction are printed, the visibility is improved and it is made possible to find the correction amount precisely.

In the embodiments described above, no mention is made of the ink ejection amount, but an additional correction may be required depending on whether the ejection amount is large or small. In this case, the above-described print correction pattern is created for each ejection amount and the correction amount is obtained for each ejection amount for each of the seven-color print mode and the four-color print mode. These obtained correction amounts are stored in the EEPROM 46 and upon reception of a print signal PS from the computer 90, the correction amount responsive to the ejection amount can be supplied to the correction circuit 153 for making an appropriate correction.

Although the embodiments of the invention has been described, various modifications of the invention are also possible. For example, the 20-dot width is adopted as the width of each pattern (block) in the first pattern group and the width ranging from 16 dots to 24 dots is adopted as the width of each pattern (block) in the second and third pattern groups; however, considering the print time and the high visibility, it is desirable that the widths of all patterns (blocks) in the first to third pattern groups should be set in the range of 3 dots to 100 dots, preferably in the range of 10 dots to 30 dots.

In the embodiments described above, rectangles are used as pattern groups, but patterns of any other shape than the rectangle (for example, trapezoid) may be used. The point is that each pattern has a predetermined width in the main scanning direction. Not only the numeral assigned to each block pair, but also the numeral of the intermediate value between the numerals assigned to the adjacent block pairs may be made able to be entered. For example, if it seems that the intermediate position between block pairs "2" and "4" corresponds to the optimum correction amount, numeral 3 may be made able to be entered. The invention can also be applied for correcting the difference between the same colors in the four-color print mode with a large-sized print head, etc. In this case, print may be executed in a single way rather than in both go and return ways so that the difference between the same colors can be visibly recognized.

Although the printer 22 including the print head for ejecting ink using the piezoelectric elements PE is used as already described, various elements other than the piezoelectric elements can be used as the ejection drive elements. For example, the invention can also be applied to a printer including ejection drive elements for ejecting ink by bubbles occurring in an ink passage as a heater placed in the ink passage is energized.

The control circuit 40 may have any configuration if it supplies a drive signal to each ejection drive element and generates a drive signal so as to keep the time-varying ejection order of ink the same in the go way and the return way of the main scanning.

Further, in the embodiments described above, the application program for printing the print correction pattern is stored in the HDD 94 (or the external storage unit 100) and the printer 22 prints the print correction pattern in response to a command from the application program. However, an application program having an equivalent function can also be stored in the PROM 43 of the printer 22 and if the user operates the operation panel 32 according to a predetermined procedure, the application program can also be started for printing the print correction pattern. The point is that the application program is stored in either the computer 90 or the printer 22 and to print the print correction pattern, the application program is started in either the computer 90 or the printer 22 for execution.

The described print processing function can be realized only by a computer. In this case, the program containing the processing description of the function that a printer should have is provided for the computer. As the computer executes the program, the described print processing function is realized in the computer. The program containing the processing description can be recorded on a record medium that can be read by the computer. The computer-readable record media include a magnetic record unit, an optical disk, a magneto-optical record medium, semiconductor memory, etc. The magnetic record units include a hard disk drive (HDD), a floppy disk (FD), magnetic tape, etc. The optical disks include a DVD (numeralal versatile disk), a DVD-RAM (random access memory), a CD-ROM, a CD-R (recordable)/RW (rewritable), etc. The magneto-optical record media include an MO disk, etc.

To distribute a program, portable record media of a DVD, a CD-ROM, etc., recording the program are sold. The program can also be stored in a storage unit of a server computer and be transferred from the server computer through a network to another computer.

In the computer for executing the program, for example, the program stored on a portable record medium or the program transferred from a server computer is stored in a storage unit of that computer. The computer reads the program from the storage unit and executes processing in accordance with the program. The computer can also read the program directly from a portable record medium and execute processing in accordance with the program. Whenever a program is transferred from a server computer, the computer can also execute processing in accordance with the received program in sequence.

According to the invention, it is made possible to print the print correction pattern rapidly, and the visibility of the print correction pattern can be enhanced, so that it is made possible to find the correction amount precisely.

What is claimed is:

1. A correcting method of a difference between dot formation positions in a reciprocal operation of a liquid ejecting head, comprising the steps of:

reciprocating the liquid ejecting head along a liquid ejecting path in a first direction and a second direction, which is an inverse direction of the first direction, the liquid ejecting head having a plurality of nozzles for ejecting liquid droplets;

ejecting liquid droplets while moving the liquid ejection head in the first direction, thereby forming first patterns;

ejecting liquid droplets while moving the liquid ejection head in the second direction, thereby forming second patterns, wherein each of the second patterns is adjacent to one of the first patterns so that the second patterns form pairs with the first patterns; and ejecting liquid droplets while moving the liquid ejection head in the second direction, thereby forming third patterns, wherein each of the third patterns is adjacent to one of the first patterns so that the third patterns pair with the first patterns;

wherein each of the first and the second patterns comprises a plurality of dots arranged in the first direction and in a third direction perpendicular to the first direction, thereby forming a block;

wherein widths of at least one of the first patterns and the second patterns vary along the first direction so that each pair of a first pattern and a second pattern has a different correction amount;

wherein each pair of a first pattern and a third pattern has a different correction amount;

wherein the second patterns and the third patterns are formed using different nozzle rows of the liquid ejecting head;

wherein a correction amount of a first nozzle row is determined based on the pairs of the first patterns and the second patterns; and wherein a correction amount of a second nozzle row is determined based on the pairs of the first patterns and the third patterns.

2. The correcting method as set forth in claim 1, further comprising a step of selecting a pair of a first pattern and a second pattern in which apposing sides of blocks are closest among the pairs, thereby selecting an appropriate correction amount.

3. The correcting method as set forth in claim 1, wherein the liquid ejecting head comprises a plurality of nozzle rows, wherein each nozzle row extends in the third direction; and wherein the first patterns and the second patterns are formed using different nozzle rows.

4. The correcting method as set forth in claim 3, wherein the first patterns and the second patterns are formed by ejecting droplets from one or more nozzles in each nozzle row; and wherein the one or more nozzles are centrally arranged in each nozzle row.

5. The correcting method as set forth in claim 1, wherein liquid droplets are ejected in a first ejecting mode for ejecting in a first number of liquid colors and in a second ejecting mode for ejecting in a second number of liquid colors;

wherein the first patterns are formed by ejecting liquid droplets from a nozzle row which is used in both the first ejecting mode and the second ejecting mode; and wherein the second patterns and the third patterns are formed by ejecting liquid droplets from nozzle rows which are used in only the first ejecting mode or the second ejecting mode.

6. The correcting method as set forth in claim 1, wherein the first patterns are formed by a single scan of the liquid ejection head and the second patterns are formed by a single scan of the liquid ejection head.

7. The correcting method as set forth in claim 1, wherein the variance in width of the at least one of the first patterns and the second patterns is a variance of width equivalent to one dot.

* * * * *